US009359565B2

(12) United States Patent
Prentice et al.

(10) Patent No.: US 9,359,565 B2
(45) Date of Patent: Jun. 7, 2016

(54) FIELD ENHANCED SEPARATION OF HYDROCARBON FRACTIONS

(71) Applicant: ExxonMobil Research and Engineering Company, Annandale, NJ (US)

(72) Inventors: Krista Marie Prentice, Bethlehem, PA (US); Jason M. McMullan, Houston, TX (US); Michel Daage, Hellertown, PA (US); Gregory J. DeMartin, Flemington, NJ (US); John Stephen Szobota, Morristown, NJ (US); Ronald M. Gould, Sewell, NJ (US); Anastasios Ioannis Skoulidas, Calgary (CA); Ajit Bhaskar Dandekar, Falls Church, VA (US); Patrick Loring Hanks, Bridgewater, NJ (US); Charles Lambert Baker, Jr., Thornton, PA (US); Lei Zhang, Basking Ridge, NJ (US); X B Cox, III, Fairfax, VA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 149 days.

(21) Appl. No.: 14/132,206

(22) Filed: Dec. 18, 2013

(65) Prior Publication Data

US 2014/0197071 A1 Jul. 17, 2014

Related U.S. Application Data

(60) Provisional application No. 61/753,145, filed on Jan. 16, 2013.

(51) Int. Cl.

| | |
|---|---|
| ***C10G 65/12*** | (2006.01) |
| ***C10G 67/02*** | (2006.01) |
| *B01D 17/00* | (2006.01) |

(52) U.S. Cl.
CPC ..... *C10G 65/12* (2013.01); *C10G 67/02* (2013.01)

(58) Field of Classification Search
CPC ..... B01D 17/005; C10G 65/12
See application file for complete search history.

(56) References Cited

U.S. PATENT DOCUMENTS

| | | | |
|---|---|---|---|
| 2,541,069 | A | 2/1951 | Jones et al. |
| 2,541,070 | A | 2/1951 | Jones et al. |
| 2,827,171 | A | 3/1958 | Frazier |

(Continued)

FOREIGN PATENT DOCUMENTS

| | | | |
|---|---|---|---|
| GB | 1358695 | A | 7/1974 |

*Primary Examiner* — Brian McCaig
(74) *Attorney, Agent, or Firm* — Robert A. Migliorini

(57) ABSTRACT

Systems and methods are provided for using field enhanced separations to produce multiple fractions from a petroleum input. A liquid thermal diffusion and/or electric field separation is used to produce the fractions. The fractions can then be used to form multiple outputs that share a first feature while being different with regard to a second feature. For example, a first fraction from the plurality of fractions can have a desired value for a first property such as viscosity index. Two or more additional fractions from the plurality of fractions can then be blended together to make a blended fraction or output. The blended fraction can have a value for the first property that is substantially similar to the value for the first fraction. However, for a second property, the first fraction and the blended fraction can have distinct values. As a result, multiple output fractions can be formed that share a first feature but differ in a second feature.

11 Claims, 13 Drawing Sheets

(56) References Cited

U.S. PATENT DOCUMENTS

| | | | |
|---|---|---|---|
| 2,970,695 | A | 2/1961 | Murphey et al. |
| 2,996,455 | A | 8/1961 | Brown et al. |
| 3,011,974 | A | 12/1961 | Henke |
| 3,180,823 | A | 4/1965 | Stothers et al. |
| 3,507,786 | A | 4/1970 | Walker et al. |
| 4,533,778 | A | 8/1985 | Henderson et al. |
| 6,008,164 | A | 12/1999 | Aldrich et al. |
| 6,025,305 | A | 2/2000 | Aldrich et al. |
| 6,322,692 | B1 | 11/2001 | Cody et al. |
| 6,783,661 | B1 | 8/2004 | Briot et al. |
| 7,000,427 | B2 | 2/2006 | Mathais et al. |
| 7,422,910 | B2 | 9/2008 | Fitzgerald et al. |
| 2002/0038777 | A1 | 4/2002 | Cody et al. |
| 2002/0040863 | A1 | 4/2002 | Cody et al. |

FIELD ENHANCED SEPARATION OF HYDROCARBON FRACTIONS

CROSS-REFERENCE TO RELATED APPLICATION

This application claims priority to U.S. Provisional Application Ser. No. 61/753,145 filed Jan. 16, 2013 herein incorporated by reference in its entirety.

FIELD

This disclosure provides systems and methods for separating petroleum fractions and other hydrocarbon fractions in the presence of thermal fields and/or electric fields.

BACKGROUND

A general problem during petroleum processing is separating desirable fractions of a petroleum (hydrocarbon) stream from other fractions that are less desirable or are desirable for a different purpose. A common example of a separation is to separate a lower boiling fraction, such as a diesel boiling range fraction, from a higher boiling fraction, such as a lubricant boiling range fraction. While separations based on boiling point are well understood, many desirable qualities in a petroleum fraction are not directly correlated with boiling point.

Liquid thermal diffusion provides a method for performing a liquid separation that is an alternative to boiling point based separations. U.S. Pat. Nos. 2,541,069 and 3,180,823 are early examples of using liquid thermal diffusion to separate hydrocarbon fractions, such as lubricant boiling range fractions. U.S. Pat. No. 3,180,823 also describes use of an additive to facilitate a liquid thermal diffusion process, and the withdrawal of multiple different fractions during a separation.

U.S. Pat. No. 6,783,661 describes a method of using liquid thermal diffusion for separation of a residue or bottoms fraction from a process for converting a distillate boiling range feed. The liquid thermal diffusion is used to separate the bottoms fraction based on viscosity index. A portion of the bottoms fraction can then be recycled for further processing.

SUMMARY

In an embodiment, a method for separating a lubricant boiling range feedstock is provided. The method includes passing a feedstock with an initial boiling point of at least 200° C. into a gap between a first surface and a second surface in a thermal diffusion separator; performing thermal diffusion separation by maintaining the feedstock in the gap with a temperature differential between the first surface and the second surface of at least 5° C. for a residence time; withdrawing a plurality of fractions from the thermal diffusion separator including a first fraction, a second fraction, and a third fraction, the first fraction having a first value for a first property and a second value for a second property; and blending at least a portion of the second fraction and at least a portion of the third fraction to form a blended fraction, the blended fraction having a third value for the first property that differs from the first value by 2.5% or less and a fourth value for the second property that differs from the second value by at least 5.0%.

In another embodiment, a method for separating a lubricant boiling range feedstock is provided. The method includes passing a feedstock with a T5 boiling point of at least 350° C. into a gap between a first surface and a second surface in a thermal diffusion separator; performing thermal diffusion separation by maintaining the feedstock in the gap with a temperature differential between the first surface and the second surface of at least 5° C. for a residence time; withdrawing a plurality of fractions from the thermal diffusion separator including a first fraction, a second fraction, a third fraction, and a fourth fraction withdrawn from a height between the first fraction and the third fraction, the first fraction having a first value for a first property; and blending at least a portion of the second fraction and at least a portion of the third fraction to form a blended fraction, the blended fraction excluding at least a portion of the fourth fraction, the blended fraction having a second value for the first property that differs from the first value by 2.5% or less, wherein a yield of product for a combination of the first fraction plus the blended fraction is greater than a yield for a contiguous blend of fractions from the plurality of fractions that has a value for the first property that differs from the first value by 2.5% or less.

In still another embodiment, a system for performing hydroprocessing is provided. The system includes a separation volume formed by a first surface and a second surface aligned to face each other and define a separation volume width of the separation volume, the separation volume having a separation volume height defined by a top surface and a bottom surface and a separation volume length, the separation volume width being from 0.25 mm to 6.0 mm, the separation volume height being at least 0.25 m, and a ratio of the separation volume width to the separation volume height being less than 500; one or more heating elements configured to maintain the first surface at a temperature; one or more first electrodes associated with the first surface and one or more second electrodes associated with the second surface; an input manifold in fluid communication with the separation volume; and a plurality of output channels in fluid communication with the separation volume, the plurality of output channels being at two or more different heights relative to the height of the separation volume.

In yet another embodiment, a method for processing a feedstock is provided. The method includes treating a feedstock with a T5 boiling point of at least 350° C., the feedstock comprising a recycled portion, in one or more hydroprocessing stages under effective hydroprocessing conditions to form a hydroprocessed effluent; passing at least a portion of the hydroprocessed effluent into a gap between a first surface and a second surface in a thermal diffusion separator; performing thermal diffusion separation by maintaining the at least a portion of the hydroprocessed effluent in the gap with a temperature differential between the first surface and the second surface of at least 5° C. for a residence time; withdrawing a plurality of fractions from the thermal diffusion separator including a first fraction having a viscosity index of at least 80, a second fraction having a viscosity index less than the first fraction and less than 90, and a third fraction having a viscosity index less than the second fraction; and recycling at least a portion of the second fraction to form the recycled portion.

In still another embodiment, a method for processing a feedstock is provided. The method includes treating a feedstock with a T5 boiling point of at least 350° C. in one or more first hydroprocessing stages under effective hydroprocessing conditions to form a first hydroprocessed effluent; passing a first portion of the first hydroprocessed effluent into a gap between a first surface and a second surface in a thermal diffusion separator; performing thermal diffusion separation by maintaining the first portion of the first hydroprocessed effluent portion in the gap with a temperature differential between the first surface and the second surface of at least 5°

C. for a residence time; withdrawing a plurality of fractions from the thermal diffusion separator including a first separated fraction and a second separated fraction, the second separated fraction having a viscosity index of at least 80; and treating a second portion of the first hydroprocessed effluent and the second separated fraction in one or more second hydroprocessing stages under second effective hydroprocessing conditions to form a second hydroprocessed effluent.

DETAILED DESCRIPTION

Figure 1:
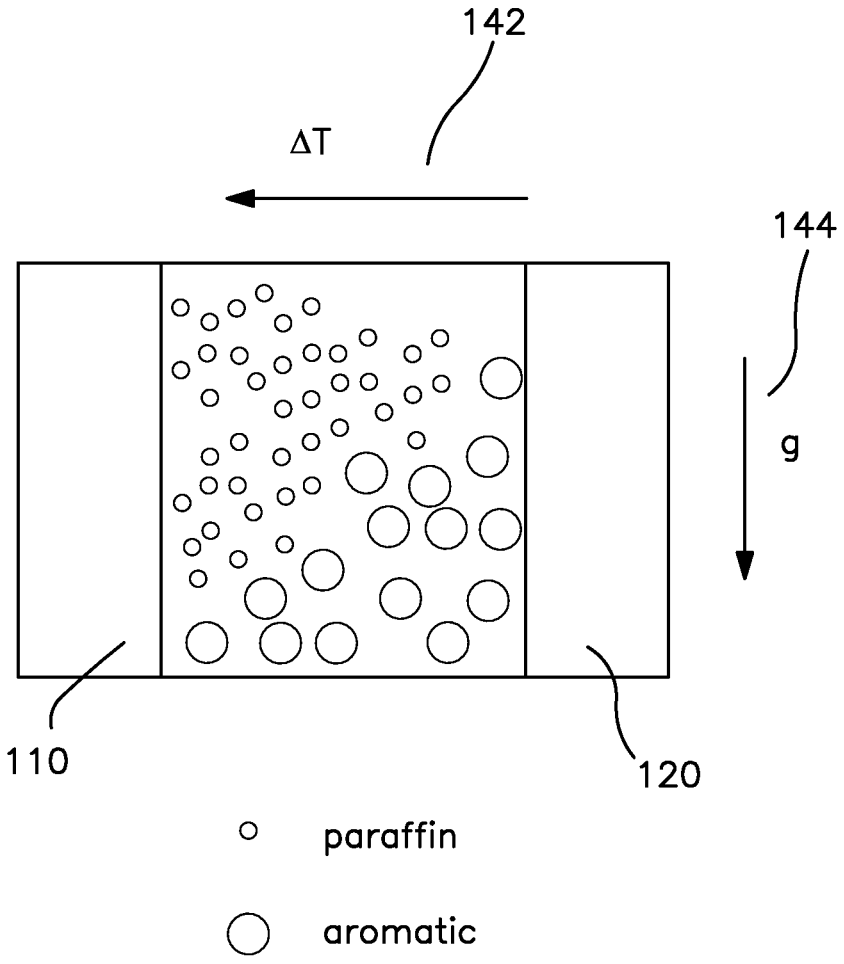
FIGS. 1 and 2 schematically show examples of configurations for performing separations by liquid thermal diffusion.

All numerical values within the detailed description and the claims herein are modified by "about" or "approximately" the indicated value, and take into account experimental error and variations that would be expected by a person having ordinary skill in the art.

Overview

In various aspects, systems and methods are provided for using field enhanced separations to produce multiple fractions from a petroleum input. A liquid thermal diffusion and/or electric field separation is used to produce the fractions. The fractions can then be used to form multiple outputs that share a first feature while being different with regard to a second feature. For example, a first fraction from the plurality of fractions can have a desired value for a first property such as viscosity index. Two or more additional fractions from the plurality of fractions can then be blended together to make a blended fraction or output. The blended fraction can have a value for the first property that is substantially similar to the value for the first fraction. However, for a second property, the first fraction and the blended fraction can have distinct values. As a result, multiple output fractions can be formed that share a first feature but differ in a second feature.

Conventionally, petroleum fractions (including feedstock and partially or fully processed products) have been separated primarily based on the boiling point of the various compounds. Boiling point separations can be used to generate a variety of fractions from a petroleum feed, such as naphtha fractions or distillate fractions. However, modification of properties within a boiling range must be achieved by another method, such as by hydroprocessing or solvent extraction.

Separations by liquid thermal diffusion provide another alternative and/or complement to boiling point separations. Instead of providing a separation based on boiling point, liquid thermal diffusion results in a separation based on molecular shape and density that roughly correlates with viscosity index. This separation can be performed without the use of additional solvents or other additives. Optionally, a liquid thermal diffusion separation can be further enhanced by applying a variable electric field during the separation.

In various embodiments, combinations of boiling point separations and liquid thermal diffusion separations can be used a variety of fractions from a feed, processing intermediate, or processing product. The ability to perform separations using two distinct techniques can enable the formation of a variety of distinct products based on product blending.

One of the difficulties with using liquid thermal diffusion or other field enhanced separation methods for separations of hydrocarbon fractions is achieving a level of throughput that is commercially useful. Conventional methods of using liquid thermal diffusion have involved building large separation devices to handle commercial scale volumes of feed. Unfortunately, such large devices also involve large residence times for performing a separation and/or require a large footprint of equipment relative to the amount of volume passing through the separator. Also, the large surface areas required for a commercial scale separator result in high energy consumption and create difficulties in maintaining a consistent temperature differential between the hot and cold surfaces of a separator.

By contrast, a liquid thermal separation according to some aspects of the invention is designed to provide a separation in a short residence time. This may result in a less complete separation, but allows for an improved throughput without requiring addition of additives to the fluid being separated to promote the separation. The separation can be further enhanced by adding an electric field, such as a uniform or non-uniform electric field, across the gap or separation volume of the separator. In some aspects, increased volumes of a petroleum input stream can be processed by using a plurality of separation units operating in parallel mode.

Contiguous, Partially Contiguous, and Non-Contiguous Fractions

Conventionally, when a product with a specific value for a property is desired, the product is generated in part by forming one or more contiguous separation fractions and blending them together. Contiguous separation fractions represent one or more fractions that are adjacent and/or contiguous within a given separation scheme. For example, consider a boiling point separation where the goal is to form a product with a boiling range of 300° F. (149° C.) to 600° F. (316° C.). One option for forming this product is to simply form a single fraction with this desired boiling range. By definition, a single fraction generated from a separation method, without further modification, is contiguous with itself. Another option is to form two separation fractions, such as a fraction from 300° F. (149° C.) to 400° F. (204° C.), and a second fraction from 400° F. (204° C.) to 600° F. (316° C.). Because these fractions represent adjacent boiling ranges, the fractions are contiguous.

In still another example, the initial boiling point separation can result in three fractions. The first fraction has a boiling range from 300° F. (149° C.) to 400° F. (204° C.), the second fraction has a boiling range from 400° F. (204° C.) to 550° F. (288° C.), and the third fraction has a boiling range from 550° F. (288° C.) to 650° F. (343° C.). In this situation, in order to blend the fractions to form a product with the desired range, all of the second fraction is desired, but only the portion of the third fraction below 600° F. (316° C.) is desired. The fractions to form the desired boiling range still represent contiguous fractions, as there is no gap between the fractions that are blended together with respect to the feature being used for the separation.

By contrast, a situation can be considered where the first fraction with a boiling range from 300° F. (149° C.) to 400° F.

(204° C.) is blended together with the portion of the third fraction that boils at 600° F. (316° C.) or less. However, the second fraction that boils from 400° F. (204° C.) to 550° F. (288° C.) is not included in the blend. In this situation, the blend is defined as a non-contiguous blend fraction, since a range of the separation variable (boiling point) is entirely missing from the blend.

Still another option is that the first fraction, the portion of the third fraction boiling below 600° F. (316° C.), and an undivided portion of the second fraction are used to form a blend. In this situation, all of the boiling ranges are represented in the blend fraction. However, there is less material present in the blend from the second fraction than would be present if a separation had been performed to generate a single fraction with a boiling range 300° F. (149° C.) to 600° F. (316° C.). This type of blend is defined as a partially contiguous fraction, since there is not a gap with respect to the separation variable, but a portion of the expected material is missing.

The above definitions were illustrated using temperature (boiling range) as the variable for separation. For liquid thermal diffusion, a fraction can be defined as contiguous, partially contiguous, or non-contiguous based on the VI of the fractions blended together. Alternatively, many types of liquid thermal diffusion systems are operated so that the product fractions are withdrawn based on the height of the separation unit. Another option for defining contiguous, partially contiguous, or non-contiguous fractions is based on the withdrawal height of a fraction from the separation apparatus.

Feedstock and Separation Products

In the discussion herein, reference will be made to petroleum, chemical, and/or hydrocarbon feedstocks. With regard to hydrocarbon feedstocks, unless specifically noted otherwise, it is understood that hydrocarbon feedstocks include feedstocks containing levels of impurity atoms typically found in a feedstock derived from a petroleum mineral source and/or a biological source. For example, a lubricant boiling range hydrocarbon feedstock could include several weight percent of sulfur, nitrogen, or oxygen, depending on whether the feedstock is of biological or mineral origin as well as the specific source of the feedstock.

In some alternative aspects, a hydrocarbon feedstock composed substantially of carbon and hydrogen can be used. In such alternative aspects, a hydrocarbon feedstock composed substantially of carbon and hydrogen is defined as a feedstock containing less than 1 wt % of atoms other than carbon and hydrogen, such as less than 0.5 wt % and preferably less than 0.1 wt %.

A wide range of petroleum and chemical feedstocks can be separated using a field enhanced separation technique, such as separation via liquid thermal diffusion in the presence of a thermal field gradient. Some examples of suitable feedstocks correspond to feedstocks that correspond to distillate boiling range or heavier materials. Such feedstocks can include, but are not limited to, atmospheric and vacuum residua, propane deasphalted residua, e.g., brightstock, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, Fischer-Tropsch waxes, oil in was streams, raffinates, other effluents or fractions of effluents derived from hydroprocessing of one of the above types of feedstocks, and mixtures of these materials. In addition, non-conventional feedstocks may be employed such as bio based feeds or lubricants. Other feeds may include polymers and/or C30+ linked molecular streams in order to isolate key polymers and/or certain shaped linked C30+ molecules (multiring structures that actually preserve the viscosity of single rings).

Some typical feedstocks include, for example, vacuum gas oils and/or other feedstocks with an initial boiling point of at least 350° C. (660° F.), such as 371° C. (700° F.). Alternatively, a feed can be characterized based on a T5 boiling point. A T5 boiling point refers to the temperature at which 5 wt % of a feed will boil. Thus, a typical feed can have a T5 boiling point of at least 350° C., such as at least 371° C. The final boiling point of the feed can be 593° C. (1100° F.) or less, such as 566° C. (1050° F.) or less. Alternatively, a feed can be characterized based on a T95 boiling point, which refers to a temperature where 95 wt % of the feed will boil. In some aspects, the T95 boiling point of a feed can be 593° C. or less, such as 566° C. or less. In other aspects, a portion of the feed can correspond to molecules typically found in vacuum tower bottoms, so that the upper end of the boiling range for the feed will be dependent on the source of the feedstock.

Other typical feedstocks include, for example, feeds with a broader boiling range, such as feeds that also include distillate fuel boiling range molecules. Such feedstocks can include molecules having a boiling range corresponding to vacuum distillation bottoms, or such heavy molecules may be excluded so that the heaviest molecules in the feedstock correspond to molecules boiling in the vacuum gas oil range. For a feedstock including distillate fuel boiling range molecules, a typical feedstock can have, for example, an initial boiling point of at least 200° C. (392° F.), such as at least 225° C. (437° F.) or at least 250° C. (482° F.). Alternatively, a feed can be characterized based on a T5 boiling point. A T5 boiling point refers to the temperature at which 5 wt % of a feed will boil. Thus, a typical feed can have a T5 boiling point of at least 225° C., such as at least 250° C. or at least 275° C. In aspects where the feed does not include molecules typically found in vacuum distillation bottoms, the final boiling point of the feed can be 600° C. or less, such as 593° C. (1100° F.) or less, or 566° C. (1050° F.) or less, or 538° C. (1000° F.) or less. Alternatively, the T95 boiling point of the feed can be 593° C. or less, such as 566° C. or less or 538° C. or less. In other aspects, a portion of the feed can correspond to molecules typically found in vacuum tower bottoms, so that the upper end of the boiling range for the feed will be dependent on the source of the feedstock.

Liquid Thermal Diffusion

FIG. 1 conceptually shows the operation of a liquid thermal diffusion separator. In FIG. 1, a liquid thermal diffusion separator includes a hot wall or surface 110 and a cold wall or surface 120. In this conceptual example, the terms hot and cold indicate the relative temperatures of surfaces 110 and 120, with hot surface 110 being at a higher temperature than cold surface 120. The hot surface 110 and cold surface 120, in combination with a top surface and a bottom surface, define a separation volume or gap 130. In this example, the length of the separation volume or gap 130 is not defined, as it corresponds to a dimension perpendicular to the plane of the page. As an example, cold surface 120 could have a temperature of 150° F. (66° C.) while the hot surface is at a temperature of 300° F. (149° C.). The direction of the temperature gradient 142 and gravitational pull 144 is also shown in FIG. 1. Typically, a liquid thermal diffusion separator is oriented so that the direction of gravitational pull is roughly orthogonal to the direction of the temperature gradient. This allows a separation to be performed based on molecular shape and density.

In the conceptual example shown in FIG. 1, a fluid in the separation volume or gap 130 between surfaces 110 and 120 would undergo liquid thermal diffusion due to the temperature differential. Molecules with higher viscosity index values, such as paraffins, will tend to congregate in the upper portion of gap 130. Molecules with lower viscosity index values, such as aromatics, will tend to congregate in the lower portion of gap 130. Two or more outlets positioned along the vertical direction of the gap 130 can then be used to withdraw fractions with differing viscosity index values.

CONFIGURATION EXAMPLES

Hot and Cold Surfaces

A variety of configurations can potentially be used for the hot and cold surfaces in a liquid thermal diffusion separator. One way of characterizing a configuration is whether the separation volume defined by the hot and cold surfaces corresponds to a closed path or circuit. Another way of characterizing a configuration is whether the hot and cold surfaces are separated by a fixed distance, a distance that varies spatially, or a configuration that can be adjusted over time so that the separation distance can change both temporally and spatially.

Figure 2:
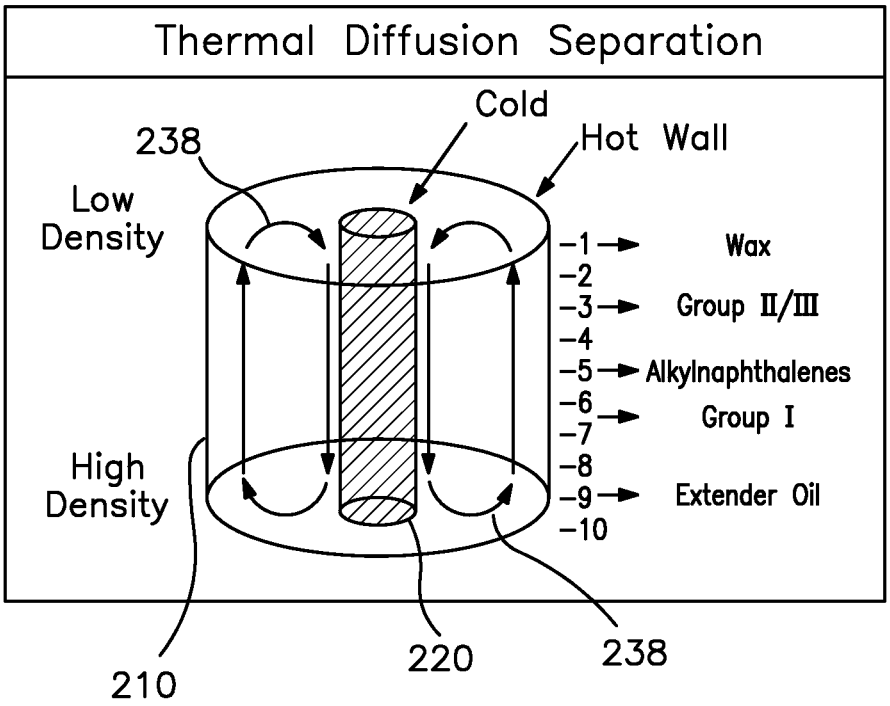

FIG. 2 shows an example of a liquid thermal diffusion separator that has a separation volume in the form of an annular gap. In FIG. 2, a separator includes an inner cold surface 220 and an outer hot surface 210. The width for the separation volume corresponds to the distance between the inner cold surface 220 and the outer hot surface 210. The separation volume height corresponds to the height of the annular volume between the cold and hot surfaces. The separation volume length corresponds to the length required to traverse the annular volume along a path corresponding to the midpoint between the outer surface 210 and the inner surface 220. Thus, if a closed loop separation volume corresponds to an annulus between two right circular cylinders, the separation volume length will correspond to a circumference of the circle defined by the midpoint between the outer surface and the inner surface. Without being bound by any particular theory, FIG. 2 shows an example of one possible flow mechanism that could result in the separation observed in a liquid thermal diffusion separator. FIG. 2 shows two separate circulation patterns 238. The circulation patterns 238 represent the potential movement of higher density molecules down in the gap and away from the inner cold surface 220, and the potential movement of lower density molecules upward in the gap and away from outer hot surface 210. This is one proposed explanation for how liquid thermal diffusion operates.

FIG. 2 also includes numbers 1-10, indicating potential outlet ports or output channels for withdrawing various fractions from the separator. After a sufficient amount of time, such as the relaxation time for the separator as will be described below, the outlet ports can be used to withdraw different types of fractions from the separator. In the example shown in FIG. 2, a hypothetical lubricant boiling range feed is considered as the input. Sample product outputs based on such a hypothetical feed are shown to illustrate the nature of the separation. The output from a liquid thermal separation of such a feed can include high VI products such as wax or Group II/III lubricant base stocks, which are withdrawn from outlet ports near the top of the separator. At lower output ports, intermediate VI products such as alkylnaphthalenes and Group I lubricant base stock can be withdrawn. The lowest ports in the separator generate low VI products, such as extender oil.

It is noted that after separation, the resulting product fractions that can be withdrawn from the output ports may have different flow properties, such as different viscosities. In a continuous flow environment, or in any other situation where withdrawal of the product fractions at comparable rates is desirable, the relative sizes of the output ports can be selected to produce similar flow rates. For example, a waxy product that is withdrawn from an output port near the top of a separator may have a high viscosity relative to a Group 1, Group II, or Group III basestock product that is withdrawn from a middle or lower portion of the separator. To compensate for this, output ports with larger sizes can be used for the ports near the top of the separator in order to control the flow and/or hydrodynamics of the separator.

Figure 3:
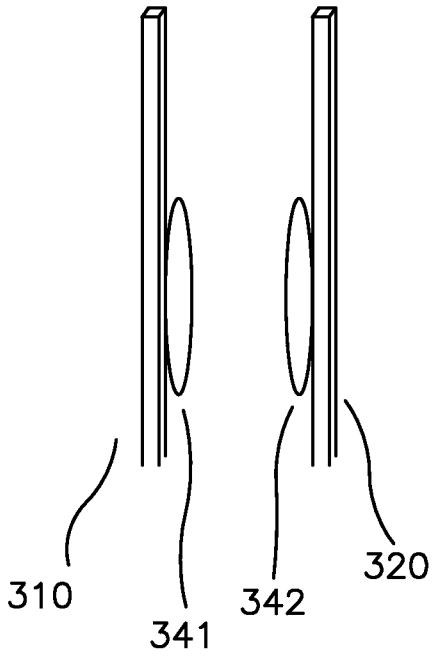
FIG. 3 shows parallel planar surfaces with optional features for reducing the distance between the surfaces.

FIG. 3 shows another example of a configuration for the hot and cold surfaces. In FIG. 3, hot surface 310 and cold surface 320 correspond to parallel planar surfaces in the form of parallel plates. FIG. 3 also includes optional protrusions 341 and 342 that narrow the gap between hot surface 310 and cold surface 320 at a location. In some aspects, optional protrusions 341 and 342 can be moved, to change the location between the surfaces where the gap is narrowed. In such aspects, the protrusions 341 and 342 can move in tandem, or the protrusions can move independently.

In a liquid thermal diffusion separator, several geometric values are relevant for determining the operation of the separator. These values include the separation volume width of the gap or separation volume containing the liquid being separated; the height of the separation volume; and the temperature differential between the hot and cold surfaces that define the gap or separation volume. In various aspects, a desirable separation can be performed using a separator with a smaller than conventional value for the ratio of separation volume height to separation volume width.

The separation volume width is defined as the distance between the hot and cold surfaces in the separator. Typically, the separation volume width will be in a direction that is orthogonal or roughly orthogonal to the direction of gravitational force. In some aspects, liquid thermal diffusion separations are performed in a separator with a separation volume width of at least 0.25 mm, such as at least 0.75 mm. Preferably, the separation volume width can be at least 1.0 mm, such as at least 1.25 mm. In order to provide an effective separation based on liquid thermal diffusion, there are practical limits to the width of the gap. As a result, the separation volume width can be 6.0 mm or less, such as 5.0 mm or less or 4.0 mm or less. It is noted that the separation volume width can vary within the gap. For a gap with a variable width, the separation volume width is defined as the width of the separation volume based on the full surface area over which the cold surface faces the hot surface.

The height of the separation volume is defined as a dimension that is approximately parallel to the direction of gravitational force. Additionally or alternately, in some aspects the separation volume height can be selected to achieve a desired amount of separation. The separation volume height can be 3.0 m (3000 mm or 9.8 feet) or less, such as 2.5 m or less, or 2.0 m or less. The separation volume height can be at least 0.25 m (250 mm), such as at least 0.4 m or at least 1.0 m or at least 1.5 m.

Additionally or alternately, in some aspects the ratio of the separation volume height to the separation volume width is selected to provide a separation volume height to separation volume width ratio of 1600 or less, such as 1000 or less or 500 or less. The ratio of separation volume height to separation volume width can be at least 50 and preferably at least 100 or at least 200. Selecting a ratio of separation volume height to separation volume width defines a balance of factors within a liquid thermal diffusion separator. Reducing the ratio of separation volume height to separation volume width limits the amount of feedstock that can be processed at one time for a given value of the third separation volume dimension. Reducing the ratio also reduces the amount of separation. However, the relaxation time required to achieve the separation is also reduced. By selecting a ratio of separation volume height to separation volume width that provides a sufficient degree of separation while also providing a sufficiently low relaxation time, the throughput for an individual separation device can be enhanced without requiring an excessive equipment footprint. By using a plurality of enhanced throughput separation devices, a commercial scale of feedstock can be processed.

The remaining dimension of the separation volume, which is orthogonal to the height and the width, can be referred to as the length of the gap for convenience. The length of the gap can be any convenient amount. In order to provide a fixed definition, for a gap that forms a closed loop (or other closed geometric shape), the length is defined as distance required to travel the closed loop at the average midpoint between the hot and cold surfaces. Thus, if a closed loop separation volume corresponds to an annulus between two right circular cylinders, the separation volume length will correspond to a circumference of the circle defined by the midpoint between the outer surface and the inner surface.

For a separation volume defined in part by opposing hot and cold surfaces that do not form a closed geometric shape, any convenient length for the separation volume can be selected, so long as a desired level of temperature control can be maintained over the surface area(s) of the hot and cold surfaces. In some aspects, the opposing surfaces can be planar surfaces, such as parallel hot and cold surfaces, or surfaces that angle toward each other. In other aspects, the opposing surfaces can be defined by a plane, but at least one surface can have a structural variation relative to the plane, such as hills and valleys in the surface, protrusions emerging from the surface, indentations within the surface, or any other convenient types of features or combinations of features. Still another option is to have at least one opposing surface that is defined by multiple planes, so that a portion of the gap has a first width and another portion of the gap has a second width.

The temperature differential between the hot and cold surfaces can be selected based on a variety of considerations. One factor is to select a sufficient temperature differential that the separation by liquid thermal diffusion occurs within a desired time frame. The greater the temperature differential is between the hot and cold surfaces, the shorter the relaxation time will be for the separation to reach separation concentration equilibrium. Another factor to consider is the characteristics of the liquid being separated. The cold surface temperature is preferably selected so that the liquid being separated, including the separated fractions resulting from the separation, will remain a liquid. If the cold surface is too cold, a portion of the liquid may crystallize to form a solid and/or form a glass structure during the separation. The kinetics of a liquid thermal diffusion are dependent on the liquid remaining in a fluid state. Thus, formation of a solid or glass phase is not desirable. For the hot surface, the temperature is preferably selected so that the liquid being separated, including the separated fractions resulting from the separation, does not undergo thermal conversion to form coke or other low value products. Still another factor for selecting the temperatures is whether the temperatures can be controlled effectively during a separation. For example, a cold surface with a temperature near room temperature may save on energy costs, but the temperature of such a cold surface may also be difficult to control if there are temperature swings in the surrounding environment. Having a temperature for the cold surface that is sufficiently different from room temperature, such as a temperature of 100° F. (38° C.) or 149° F. (65° C.), can assist with maintaining a stable temperature differential between the hot and cold surfaces.

In general, the temperature differential between the hot surface and the cold surface can be from 5° C. to 500° C. From a practical standpoint, a temperature differential of at least 50° C. is preferable, such as at least 75° C. or at least 100° C. Having at least a 50° C. (or at least 75° C. or 100° C.) temperature differential improves the relaxation time required to achieve equilibrium in a separation. Additionally or alternately, the temperature differential between the hot surface and the cold surface can be 300° C. or less, such as 200° C. or less or 175° C. or less.

In order to illustrate the benefits of a larger value for the ratio of separation volume width to separation volume height, a liquid thermal diffusion separation for a two component system is described below. The principles of operation for a two component system are similar to a multi-component system while providing a more convenient mathematical form.

In a liquid thermal diffusion separation of a two component system, the amount of separation that can be achieved is defined by the equation:

$$\Delta c = \frac{504 L_z}{g L_x^4} \frac{D_T \nu}{\alpha} c_0 (1 - c_0) \tag{1}$$

where $\Delta c$ is the concentration difference between the two ends of a separation volume at steady state, g is the gravitational constant, $L_z$ is the separation volume height, $L_x$ is the separation volume width, $D_T$ is the thermal diffusivity, $\nu$ is the kinematic viscosity, $\alpha$ is the thermal expansion coefficient, and $c_0$ is the initial concentration of a component in the two component mixture. As shown in Equation (1), the amount of separation increases linearly with the height of the separation volume but decreases based on the separation volume width to the fourth power. Thus, reducing the ratio of separation volume height to separation volume width will result in a reduced amount of separation. However, if the reduced amount of separation provided at a given ratio of separation volume height to separation volume width is sufficient, reducing the ratio of separation volume height to separation volume width has advantages for the relaxation time $t_r$ required to achieve the separation shown in Equation (1).

$$t_r = \frac{9!(L_z \nu)^2 D}{(g \pi \alpha \Delta T L_x^3)^2} \tag{2}$$

In Equation (2), D is the molecular diffusivity and $\Delta T$ is the temperature differential between the hot and cold surfaces in the separator. Here, the relaxation time increases as the square of the separation volume height and decreases based on the separation volume width to the sixth power. As shown in Equation (2), reducing the ratio of separation volume height to separation volume width will reduce the relaxation time required to achieve the concentration gradient described by Equation (1).

Electric Field Enhancement

In order to further improve the relaxation time for a separator based on liquid thermal diffusion, an electric field can be used to enhance the rate of separation. In particular, an electric field that is applied along the width of the separator can increase the rate of diffusion for molecules within the gap based on electrophoresus for uniform fields or dielectrophoresis for non-uniform fields.

In a typical petroleum feedstock or other hydrocarbon feed, the vast majority of molecules or particles within the feed will be neutral and will not have a net charge. If a uniform electric field is applied to a liquid feed that contains molecules or particles without a net charge, the uniform electric field will have only a minimal impact on the diffusion of molecules within the liquid. A uniform electric field may be effective for aligning molecules with dipole moments, but no net translational force will be exerted on the molecules or particles in the liquid.

By contrast, dielectrophoresis corresponds to diffusion of molecules in a non-uniform electric field based on the permittivity (i.e., complex dielectric constant) of the molecules. The electric field can be a spatially varying electric field, a time varying electric field, or a combination thereof. In diffusion based on dielectrophoresis, the electric field will induce a dipole in the various species contained in a fluid exposed to the electric field. While such an induced dipole will not result in a translational force in a uniform electric field, in a non-uniform electric field the induced dipole can result in a translational force based on the gradient of the field. In general, species with a permittivity that is greater than the permittivity of the surrounding medium will diffuse toward areas of stronger electric field, while species with a permittivity that is less than the surrounding medium will diffuse toward areas of weaker electric field.

Equation 3 shows a general formula for the flux of molecules (or other species) within a liquid based on various types of diffusion. In Equation 3, the flux for a molecule or species $J_i$ (in kg/m$^2$s) corresponds to a first term based on mass diffusion (or Brownian motion), a second term based on thermal diffusion, and a third term based on dielectrophoretic diffusion.

$$J_i = -\rho D_{m,i} \nabla Y_i + D_{T,i} \frac{\nabla T}{T} + D_{E,i} \nabla (E^2) \tag{3}$$

In Equation 3, ρ is the density of the fluid, $D_{m,i}$ is the mass or Brownian motion diffusion constant for species i, and $Y_i$ is the concentration of species i in the fluid; $D_{T,i}$ is the thermal diffusion constant (or thermal diffusivity) for species i and T is the temperature; and $D_{E,i}$ is the electrophoretic diffusion constant for species i, and E is the electric field. In Equation 3, the first term (corresponding to Brownian motion) tends to cause mixing of species within the fluid. By contrast, the second term (corresponding to thermal diffusion) and the third term (corresponding to dielectrophoresis) tend to promote separation of species within a fluid. However, based only on Equation 3, the separation promoted by the second term (thermal diffusion) is not necessarily aligned with the separation caused by the third term (dielectrophoresis).

In a petroleum or hydrocarbon-type feed, paraffinic type molecules will tend to have smaller induced dipoles while aromatic molecules will tend to have larger induced dipoles. As a result, a properly aligned non-uniform electric field can be used to enhance a liquid thermal diffusion process. A non-uniform electric field with lower field near the hot wall will tend to enhance the diffusion of paraffins toward the hot wall. Similarly, a higher electric field near the cold wall will tend to enhance the diffusion of aromatics toward the cold wall.

A variety of potential configurations are available for providing a non-uniform electric field in the gap between the hot and cold surfaces of a separator using liquid thermal diffusion. One option is to simply use an electric field generator that can generate an oscillating electric field, which results in temporal field variations. This would allow for generation of a varying electric field even if the electrodes generating the field were two parallel plate electrodes. Additionally or alternately, a number of options are available for generating a spatially varying electric field.

Figure 4:
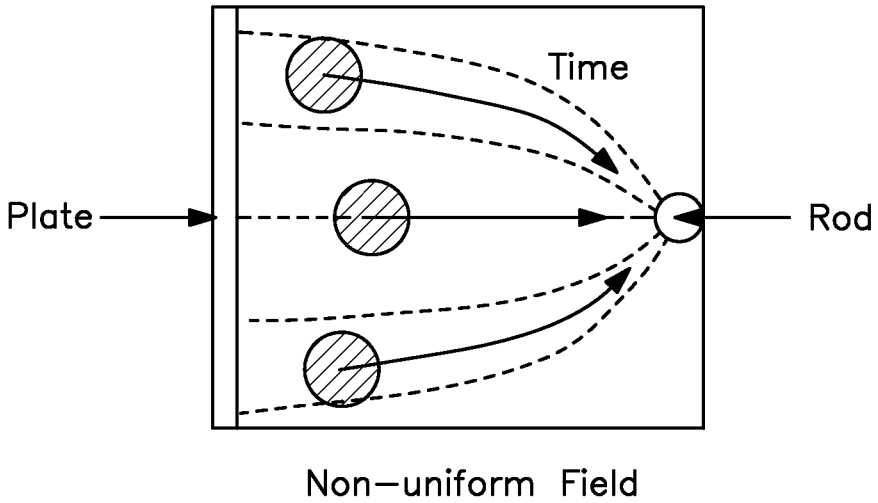
FIGS. 4 and 5 schematically show examples of electrode configurations.

One simple example of a spatially varying electric field is to use a plate electrode on one side of the gap and one or more point electrodes (or approximately point electrodes, such as rods, small spheres or hemispheres, or dimples) on the other side of the gap. FIG. 4 shows an example of the electric field generated from having a plate electrode on one side of the gap and a point electrode on the other side. In FIG. 4, lines of constant E field are shown between the point electrode and the plate electrode. Instead of using one point electrode, any convenient number of electrodes with surface area facing the plate can be used. In a limiting case, a sufficient number of point, rod, small sphere, etc. electrodes could replicate the effects of a plate electrode, resulting in little or no spatial variance in the electric field. However, as long as the width of the gap is not substantially larger than the spacing between electrodes (such as 50 times larger or 100 times larger), using a plurality of point electrodes will result in a spatially varying electric field with gradients that can induce dielectrophoretic diffusion. Still other combinations of point source electrodes, (or approximate point sources), small plate electrodes with distances between the plates, and or protruding electrodes can be used.

Figure 5:
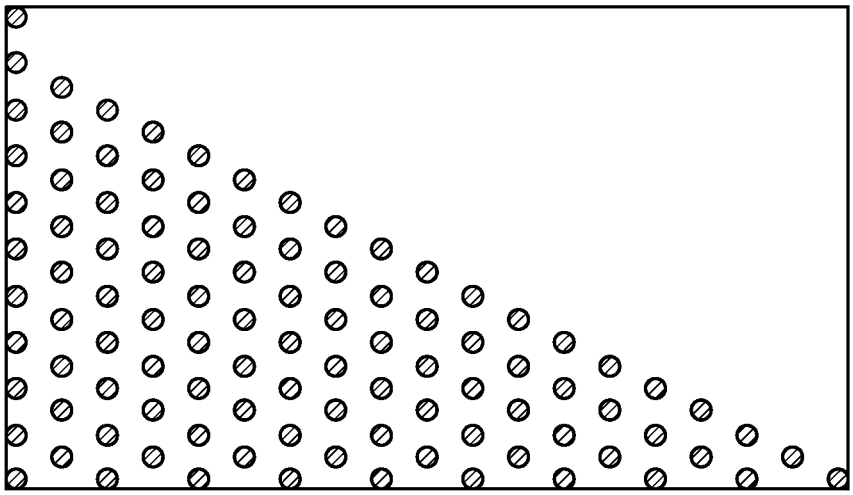

FIG. 5 shows an example of a point, rod, small sphere, or dimple electrode configuration that can be used to enhance a liquid thermal diffusion separation. The example shown in FIG. 5 represents only one of two electrodes. The opposing surface can have any convenient type of electrode, such as a plate electrode. The example shown in FIG. 5 uses a plurality of point (or approximately point) electrodes to form a triangular shape. The descending hypotenuse of the triangle results in an electric field gradient that can assist molecules with larger induced dipole moments in traveling to the bottom of the separator.

Separation Products

A field enhanced separation can be used to generate a plurality of products, and preferably at least three products, from an input feed to a separator. Similar to a fractionator, the plurality of products can be withdrawn from a liquid thermal diffusion separator at various heights. The number of different products withdrawn from a separator can depend on the types of desired products and the nature of the input feed to the separator.

In an aspect where a general separation of a lubricant boiling range feed is desired, a variety of products can be derived using a field enhanced separation, such as a separation based on liquid thermal diffusion. The separation can generate one or more wax fractions; one or more basestock fractions, including one or more fractions for various types of basestocks, such as Group I or Group II/III basestocks; one or more other fractions such as alkylnaphthalene fractions or diesel fractions; one or more extender oil fractions; and/or a combination of any of the above. In some aspects, an advantage of using liquid thermal diffusion for separation is the ability to separate out fractions that roughly correspond to various viscosity index (VI) components of a feed. In the list of fractions mentioned above, the wax fractions represent the highest VI components, with Group II/III basestocks being next highest in VI. The trend from high to low VI can continue down through the various fractions to the extender oil, which represents the lowest VI fraction.

One example of a use for a field enhanced separation (such as a liquid thermal diffusion separation) is to debottleneck existing solvent extractions units. Using a field enhanced separation can allow for lower severity conditions and an increase in yield across existing solvent extraction units. For example, a liquid thermal diffusion separator can operate on the back end of a solvent extraction unit to upgrade the resulting viscosity index (VI) of the raffinate. This can allow the solvent extraction unit to operate at a lower severity. The liquid thermal diffusion separator, which is more selective for separating based on VI, can then perform a final separation to achieve a desired VI value. This can allow for an increase in yield at a given VI value. In addition to upgrading the VI of the resulting raffinate, a field enhanced separation method can also dewax the raffinate at the same time to produce wax in addition to other products (i.e. Group III lube, Group II lube, alkylnaphthalenes, Group I lube and extender oil).

A field enhanced separation process (such as liquid thermal diffusion) can also operate on the extract stream from a solvent dewaxing unit to separate out desirable lubricant boiling range molecules and/or high VI components from the extract stream. Without being bound by any particular theory, it is believed that 10%-30% of high VI components are left behind in the extract of a typical solvent dewaxing process due to the imperfect separation quality of the solvent extraction process. By separating out high VI components from the extract, the resulting yield of Group I, II, or III lube is increased. In addition, the inventive process may also separate out alkylnaphthalenes and extender oil from the extract at the same time as separating out the high VI components.

More generally, a field enhanced separation process (such as a liquid thermal diffusion separation process) can be used to replace a solvent extraction and/or solvent dewaxing process in a process flow. Both extraction and dewaxing separations can occur during one stage of a field enhanced separation. In addition, further processing such as deoiling of wax is typically not necessary due to the multiple product output streams that can be generated.

Another option is to use a liquid thermal diffusion separator to operate on a slip stream to produce products of special quality and/or high value which are of limited demand. The invention may also provide blend stocks at a competitive price on an integrated project economic basis.

Still another option is to use a liquid thermal diffusion separator to remove material that could produce deposits, such as potential contaminant materials encountered in used lubricant streams and bio-derived streams. In this aspect, the field enhanced separation would serve as a pretreatment step. A field enhanced separation may also be used to isolate desired polymers from a polymer stream.

A field enhanced separation may also isolate linked ring structures ($C_{30}$) from a feed. The linked ring structures can assist in preserving the viscosity of single ring structures. However, in a conventional separation process, linked ring structures are often separated from single ring structures based on boiling point differences or solubility differences. A field enhanced separator can that generates multiple products can include one product outflow that is enriched in the desired linked ring structures.

A field enhanced separation may include various strategies to perform a separation and/or concentrate a desired component. Such strategies may include multi-staging, skimming, reverse skimming, and recycling. In order to achieve a desired yield of various products, multi-staging may occur such that more than one process step is employed. All products, a subset of products, or a combination of blend components from one unit or stage may enter into a second unit or stage as incoming feedstock. Multiple stages may be employed to achieve the desired end result.

Skimming may occur on a feedstock to selectively remove a desired component from the bulk feed (i.e. wax). The feedstock may be any feed containing the desired component (i.e. crude, VGO, raffinate, bio based feeds, etc.). In contrast, reverse skimming may include removing the bulk unwanted component(s) from the feedstock, such as multi-ring aromatics, so as to concentrate high VI components. Reverse skimming may be combined with multi-staging such that after the bulk unwanted components are removed in the first stage, the desired components can be further separated or refined in subsequent stages. Skimming may also be combined with multi-staging.

Recycling is another strategy to concentrate a desired component. For example, when separating out wax, the first two or three ports of a thermal diffusion or thermal electric diffusion separator may contain wax or highly paraffinic components. It may be desired to separate out all the possible wax molecules in the bulk feedstock. As a result, one strategy is to collect both as much wax and as much oil in wax as possible by taking products from the first several ports as opposed to just the top port which may be essentially oil free and pure wax. In order to remove the oil in wax from the ports of interest, it is necessary to recycle a portion of the stream to further refine the wax and remove the oil. This method is a strategy to not only separate out more wax molecules from a feedstock but also a strategy to concentrate the wax such that it is deoiled with no additional processing steps required.

Combinations of strategies may be employed and desired to achieve necessary yields or specific products. In addition, strategies may be used to blend components or molecular classes from the various product ports together in various combinations to achieve desired yields, product composition of matter, and product performance. Furthermore, the strategy of blending components from various ports may be done in combination with multi-staging, skimming, reverse skimming, and recycling. For example, blends from one processing step may be used as feed for a second processing step, a blend may be skimmed or reverse skimmed as well as recycled.

In addition to the above strategies, the resulting fractions or products from thermal diffusion or thermal electric diffusion can be combined to form various non-contiguous or partially contiguous fractions. Forming partially contiguous or non-contiguous fractions can be beneficial for a variety of reasons. One option is to use a non-contiguous fraction to allow multiple products to be generated that share a first property, but that differ in a second property. For example, it may be desirable to separate a distillate or lubricant base oil boiling range feed to form multiple fractions that have substantially the same viscosity index, but that are different in a second property. The second property can be total product yield; one or more compositional indicators including but not limited to total aromatics content, the content of a particular type of aromatic (such as 1-ring aromatics, 2-ring aromatics, 3-ring aromatics, or multi-ring aromatics), aliphatic sulfur, total S, total N, or the ratio of aliphatic sulfur to total sulfur; or one or more performance indicators, including but not limited to oxidation stability, deposit tendency, Noack volatility, or a cold flow property such as pour point or cloud point; or a combination thereof. In this situation, a first contiguous fraction can be used that matches the desired first property value. This can represent a single fraction from the liquid thermal diffusion separator, or a contiguous/partially contiguous blend from the separator. A second non-contiguous fraction is then formed that has a value for the first property that is substantially similar to the value for the contiguous fraction. Two values are defined to be substantially similar if the values differ by less than 2.5%, such as by less than 2.0% or less than 1.5%. For the description herein, the percentage difference between two values is defined as (<contiguous property value>−<non-contiguous property value>)/<contiguous property value>.

In addition to having similar values for the first property, the contiguous/partially contiguous fraction and the non-contiguous fraction have values for a second property that differ by at least 5.0%, such as at least 7.5% or at least 10%. The same definition is used for determining the percentage difference in values for the second property.

Either the first property or the second property can be any convenient property of interest. Examples of suitable properties for the first property or the second property include total product yield and/or compositional/performance indicators, such as viscosity index, viscosity at 100° C., viscosity at 40° C., pour point, cloud point, Noack volatility, oxidation stability, deposit tendency, weight percentage of sulfur, ratio of aliphatic sulfur to total sulfur, weight percent of nitrogen, weight percentage of aromatics, or weight percentage of a particular class of aromatics (such as 1-ring aromatics, 2-ring aromatics, 3-ring aromatics, or multi-ring aromatics). It is noted that for properties that correspond to a temperature value, such as pour point or cloud point, the calculation of the percentage difference should be performed using an absolute temperature scale. Thus, pour point or cloud point temperatures should be expressed in Kelvin rather than degrees Celsius when determining a percentage difference.

As another example, non-contiguous and/or partially contiguous blend fractions can be used to create an enhanced yield of a product with a given property. Conventionally, the method for maximizing yield of a product with a given property value is to separate out the largest contiguous fraction that has the desired property value. This strategy can be conventionally used with either a boiling point separation or a liquid thermal diffusion separation.

An alternative strategy for increasing yield is to form a non-contiguous fraction that has the desired property, so that the non-contiguous fraction can be combined with a contiguous or partially contiguous fraction that also has the desired property. In a sense, this corresponds to having a contiguous (or partially contiguous) fraction and a non-contiguous fraction that have a substantially similar value for a first property. The second "property" in this situation is the yield of product with the first property. The yield of product for the combination of the contiguous and non-contiguous fraction can be greater than the maximum yield for a contiguous fraction having the desired property value.

It is noted that in this alternative strategy for improving yield, if the non-contiguous fraction simply represents end fractions on either side of a middle contiguous fraction, the requirement of increasing yield will not be satisfied. Instead, the yields should be identical for the comparison of the middle contiguous fraction plus end non-contiguous fraction case versus the single large contiguous fraction case. Thus, an additional implied constraint on this embodiment is that combining the non-contiguous fraction with the contiguous fraction should result in an overall fraction that is either partially contiguous or preferably non-contiguous.

Configuration Example

Parallel Plates with Spatially Varying Electric Field

Figure 6:
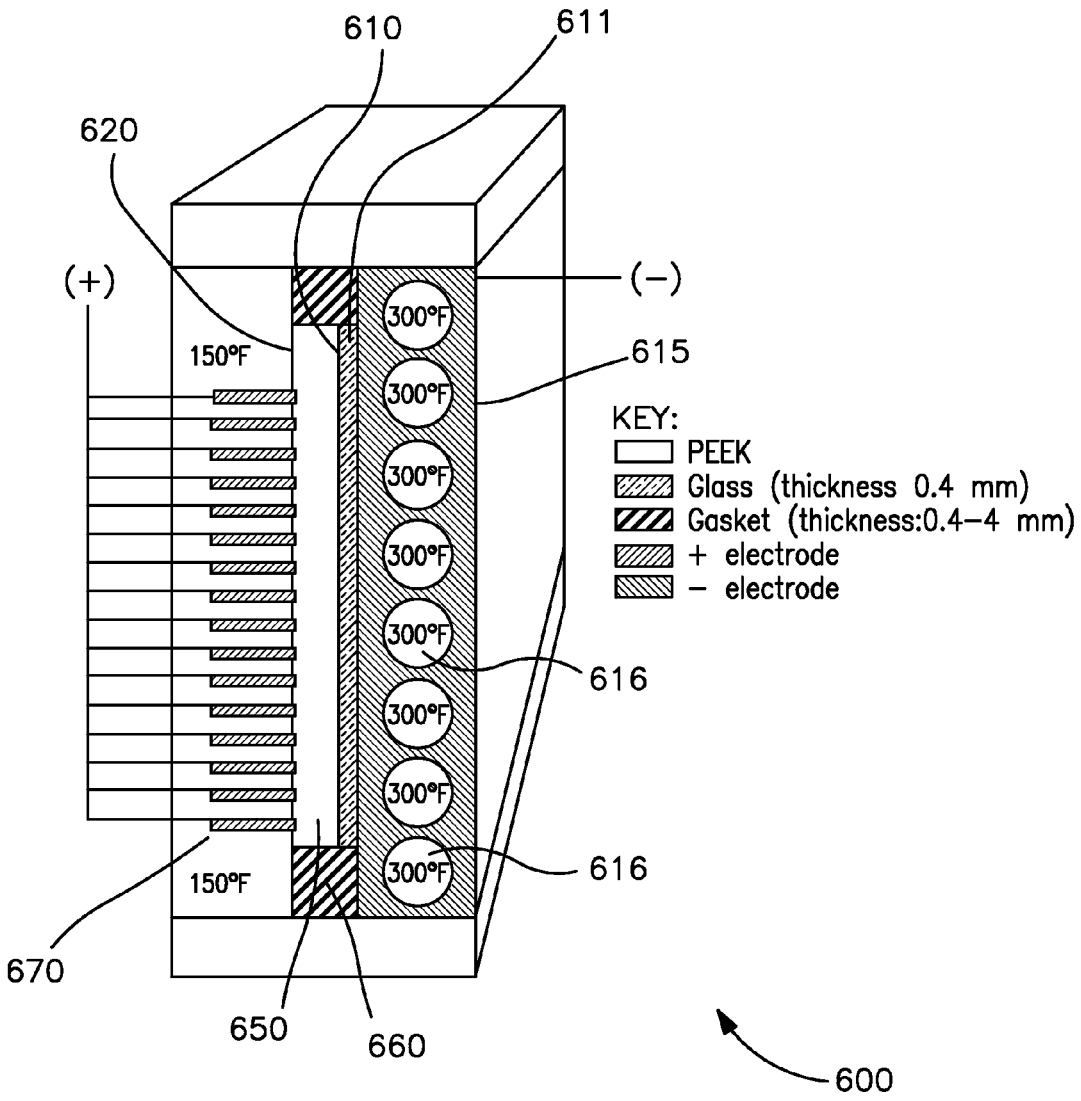
FIG. 6 schematically shows an example of a configuration for performing a field enhanced separation.

FIG. 6 shows an example of a separator that can use both liquid thermal diffusion and dielectrophoresis for separation of a petroleum or hydrocarbon feedstock. In FIG. 6, a separator 600 can be used for continuous separation of a feedstock into a plurality of product fractions. Separator 600 includes a hot surface 610 and a cold surface 620 that are parallel to each other. In the example shown in FIG. 6, hot surface 610 corresponds to the surface of an optional protective layer 611, to prevent interaction between hot surface 610 and the fluid being separated. A similar optional protective layer could be used to protect cold surface 620. The bulk material 615 behind hot surface 610 includes a plurality of heating fluid channels 616 to provide temperature control for hot surface 610 via heat exchange. The heating fluid channels represent one possible structure for heating elements to heat a surface in a field enhanced separation. Other alternatives for heating elements include resistive heaters located in the bulk material at or behind surface 610 or any other heating mechanism that allows the temperature of hot surface 610 to be maintained at a desired level. The temperature of cold surface 620 can be controlled in a similar manner. Any convenient fluid can be used as the heat exchange fluid in channels 616, such as steam or any heat transfer fluid, such as ethylene glycol and/or silicone heat transfer fluid like Syltherm.

The distance between hot surface 610 and cold surface 620 (or between optional protective surfaces 611) defines a gap or width 650. The fluid for separation is passed in a continuous manner into gap 650. The separation occurs as the fluid flows through the channel corresponding to the gap. In FIG. 6, the flow direction for this channel is perpendicular to the plane of the page. The width of the gap 650, or alternatively the distance between hot surface 610 and cold surface 620, can be controlled using an adjustable spacer or spacers 660.

In the example shown in FIG. 6, the bulk material 615 behind hot surface 610 serves as a plate electrode for forming an electric field across gap 650. Instead of having a plate electrode on the opposite side, a plurality of point electrodes 670 or other electrodes corresponding to small protrusions extending past cold surface 620 are used. These small protrusion or point electrodes 670 can correspond, for example, to protrusions from a circuit board that resides behind cold surface 620. Using a plurality of point electrodes 670 opposite a plate electrode (corresponding to bulk material 615) results in a spatially varying electric field across gap 650. Either an AC or DC current can be used to charge the electrodes.

As an example of how to construct a separator, some representative distances can be provided for the elements shown in FIG. 6. The width of gap 650 can be between 0.25 mm and 6.0 mm. The optional protective layer 611 can be 0.4 mm, so the spacers 660 can change in width from 0.8 mm to 4.4 mm. The height of the channel can be 22 inches (559 mm). This would lead to ratios of gap height to separation volume width of from 2200 (at a width of 0.25 mm) to 193 (at a width of 6.0 mm). Preferably, the separation volume width can be selected to be at least 1.22 mm, to produce a gap height to separation volume width ratio of 500 or less. The length (perpendicular to the plane of the page) for gap 650 can also be 16 inches (406 mm).

During operation, the fluid flow rate can be selected to provide a desired residence time for a fluid as it passes through the channel corresponding to gap 650. A desired residence time could range from 4 hours to 40 hours, depending on the corresponding relaxation time required for separation of the fluid in the channel to reach equilibrium. A plurality of products can be withdrawn from the exit of the channel (not shown). For example, 7 output ports can be used to withdraw 7 different products from the channel, with the top output port generating the highest VI product and the bottom output port generating the lowest VI product.

As examples of suitable materials for constructing a separator, the material for forming cold surface 620 (and for containing electrodes 670) can be a material such as polyethyl ether ketone (PEEK). Such a material is non-conductive and will not react with typical petroleum or hydrocarbon feedstocks. The protective layer 611 can be a glass material or another material that is non-reactive and non-conductive in the separation environment. The bulk material 615 can be a material with suitable heat transfer and electrical properties, such as PEEK. The spacers can be made of a suitable material, such as Viton® gasket material.

Example 1

Separation by Liquid Thermal Diffusion of Dewaxed Vacuum Distillate

Figure 7:
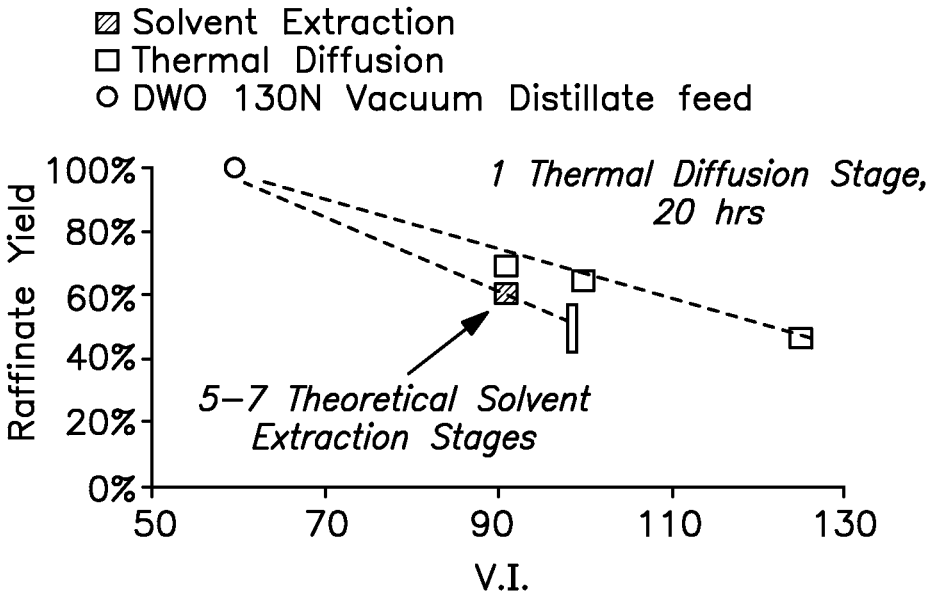
FIG. 7 shows separation data from separations performed using liquid thermal diffusion.

In this example, a comparison is made between the products that can be derived from a feed using solvent dewaxing relative to the products that can be achieved using liquid thermal diffusion for performing a separation. For comparison purposes, a 130N dewaxed vacuum distillate was solvent extracted in a conventional solvent extraction process. Based on the results, the potential raffinate yield and VI combinations for the process were estimated for a process including 5-7 theoretical stages. As shown in FIG. 7, the selected solvent extraction conditions were predicted to result in a 60% yield of a 91 VI product at 5-7 theoretical solvent extraction stages. In the limiting case, a maximum possible product VI was predicted, at a yield of 50%.

A sample of the 130N dewaxed vacuum distillate was also separated into fractions by liquid thermal diffusion. A thermal diffusion column was used to perform the separation. The annular volume for performing the separation had a separation volume width of less than 0.33 mm, a height of 72 inches, and a load volume of 30 ml. The temperature differential between the hot and cold surfaces was 200° F. The separator included 10 output ports for withdrawing product fractions from the separator.

After performing the separation for 18 hours, product fractions were withdrawn from the separator using the output ports. Based on the number of product fractions that were combined into the product, several different products could be generated. As shown in FIG. 7, for the highest VI product, a 46% yield of 125 VI product was achieved. As noted above, a product with a VI of 125 is a product that cannot be generated from the 130N dewaxed vacuum distillate feedstock via solvent extraction/dewaxing. By including a larger portion of the separation products into the high VI product, a 64% yield of a 100 VI product or a 69% yield of a 91 VI product could also be achieved. Based on the results from the solvent dewaxing, use of a liquid thermal diffusion separation can provide a 9% yield increase at a constant product VI of 91, or a 4% yield increase and 9 VI improvement for the 100 VI product.

Example 2

Separation by Liquid Thermal Diffusion of Dewaxed Lubricant Base Stock Feed

Column separators for performing liquid thermal diffusion separations as described above were used to perform separations on a Group I basestock with a VI of 95 for various lengths of time. The separation times were 18 hours, 43.5 hours, 89 hours, and 185.5 hours. The temperature differential between the hot and cold surfaces was 130° F. to 190° F.

In the following discussion, port 1 of the separator corresponds to the top output port and port 10 corresponds to the lowest output port. After the desired separation time for each run, products were withdrawn from each of the 10 ports. The product fractions from each port were tested to determine kinematic viscosity at 40° C. and 100° C., pour point, and cloud point. During the separations, the output fractions from ports 1-5 reached equilibrium in 20 hours or less. By contrast, port 9 did not reach equilibrium until 90 hours. Part of the difficulty in reaching equilibrium for the product fractions corresponding to the higher numbered ports may be due to difficulties in achieving a uniform temperature profile. During the separations, a uniform temperature profile was not achieved until 18 hours into the separation.

Figure 8:
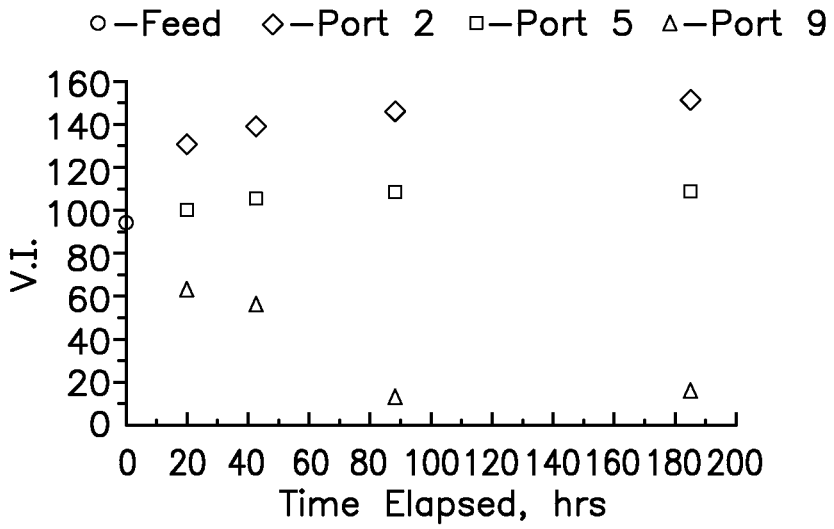
FIGS. 8 and 9 show separation data from separations performed using liquid thermal diffusion.

FIG. 8 shows the viscosity index (VI) for the products fractions withdrawn from ports 2, 5, and 9 for various run lengths. The vertical axis shows the VI for the product fraction while the horizontal axis shows the run length for the corresponding separation. As shown in FIG. 8, liquid thermal diffusion was effective for separating the Group I lube feedstock into higher and lower VI product fractions. The output from port 2 corresponded to a product fraction with increased VI relative to the feed VI of 95. The product VI for the port 2 fraction ranged from 130 at 18 hours to 150 at 180 hours. The output from port 5 also showed an increased VI relative to the feedstock, with VI values between 100 and 110 depending on the run length. Port 9 showed the largest changes with increased run length. For the run lengths at 20 and 43.5 hours, the VI of the port 9 product fraction between 60 to 70. At 90 hours and longer, however, the VI for the product fraction from port 9 dropped to 10 or less.

Figure 9:
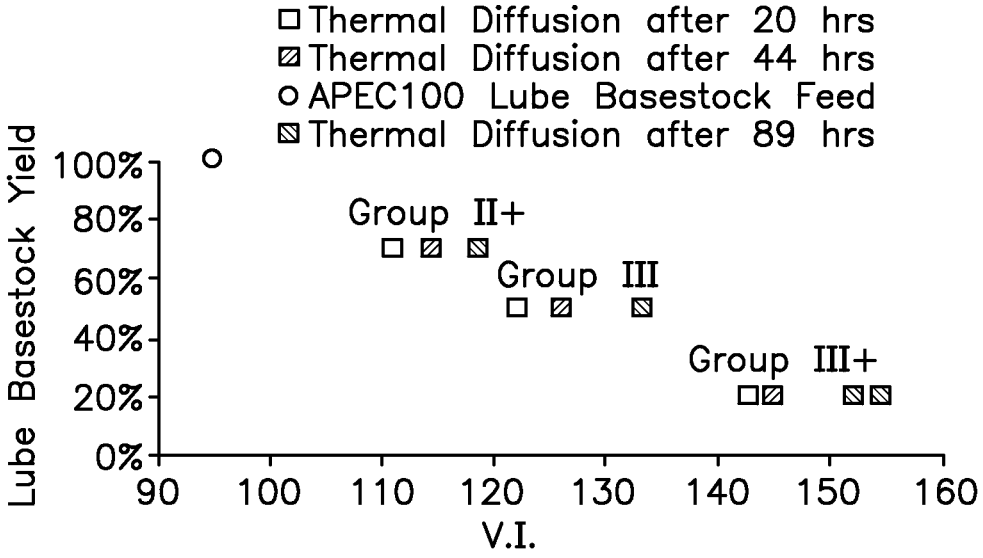

FIG. 9 shows the lubricant basestocks that can be formed by combining the output fractions from various ports. In FIG. 9, the yield of a lubricant basestock having a particular VI value is shown. The farthest right points in the plot represent a product fraction generated by combining the output of ports 1 and 2 from the separator. This resulted in a 20% yield of a basestock with Group III+ equivalent VI. At shorter times, such as 20 hours or 43.5 hours, a 20% yield of a 143 or 145 VI basestock was achieved. The separation with a run length of 89 hours resulted in a 20% yield of a basestock with a VI of 155. For the 18 hour run length, separating out 20% of the feedstock with a 143 VI resulted in a remaining portion corresponding to 80% of the feedstock that had an 82 VI.

The middle set of data corresponds to forming a basestock from the product fractions of ports 1-5. This resulted in a 50% yield of a basestock with VI equivalent to a Group III basestock. Again, the VI of this fraction increased with increasing run length, with a VI of 122 at 20 hours versus a VI of 135 at 89 hours. The leftmost set of data corresponds to forming a basestock from the product fractions of ports 1-6. This resulted in a 70% yield of a basestock with VI equivalent to a Group II+ basestock, with VI values ranging from 110 (20 hours) to 120 (89 hours).

Example 3

Example of Non-Contiguous Blend

In this example, a lubricant boiling range feed is separated using a thermal diffusion separation apparatus similar to the apparatus in Example 2. In this example, it is desired to create multiple output fractions that have a VI of 117+/−2.5%. In this example, the fraction from port 2 of the separator corresponds to the desired VI. A second product with the desired VI is formed by blending the fraction from port 1, the fraction from port 3, and 85% of the fraction from port 4. Table I shows the properties of the feed, the fraction from port 2, and the non-contiguous blend fraction.

TABLE 1

| Description | Saturates (wt % | Aromatics (wt %) | Total S (wt %) | Ratio of Aliphatic S to Total S | Total N (ppm) | VI |
|---|---|---|---|---|---|---|
| Feed | 81.2 | 17.1 | 0.430 | 0.672 | 27 | |
| Port #2 fraction | 85.8 | 13.2 | 0.212 | 0.759 | 8.6 | 117 |
| Blend fraction | 85.4 | 12.9 | 0.232 | 0.797 | 11 | 119 |

As shown in Table 1, two separate output fractions with a desired VI are formed. The difference in VI between the two samples, per the method of calculation defined above, is (117-119)/117=1.7%. In this example, the ratio of aliphatic sulfur to total sulfur represents a second property within the output fractions. The difference in aliphatic sulfur to total sulfur ratio is (0.759-0.797)/0.759=5.0%. Thus, two separate output fractions are formed, with a first property (VI) that differs by less than 2.5%, such as less than 2%, while a second property (aliphatic S/total S) differs by at least 5.0%.

Tables 2 and 3 show examples of how the ports from a thermal diffusion unit (TDU) can be used to generate a desired product. In this example, the desired product is a lubricant basestock output with a VI of 117. In the TDU, the port heights are adjusted so that Port 2 generates the desired product. Table 2 shows the output from ports 1 to 4 of the TDU. In a typical configuration, the thermal diffusion separation of the feed results in only 3 ml of the desired product.

TABLE 2

| Feed Charge: 30 ml | Port 1 | Port 2 | Port 3 | Port 4 | Upgraded Product | VI |
|---|---|---|---|---|---|---|
| TDU Port Output | 3 ml | 3 ml | 3 ml | 3 ml | | |
| Port #2 Product | | 3 ml | | | 3 ml | 117 |

Table 3 shows an alternative method for using the output from the same ports for a TDU. In the configuration corresponding to the outputs in Table 3, the outputs from ports 1, 3, and 4 are combined to generate additional amounts of the desired product. As shown in Table 3, in this example a blend using non-contiguous fractions (ports 1, 3, and 4) produces a product which has the same desired property VI as the product fraction from port 2. The yield of this second blend is 6.8 ml. Thus, the total yield of the desired product with 117 VI is 9.8 ml, as opposed to the 3 ml yield from only the port 2 product.

TABLE 3

| Feed Charge: 30 ml | Port 1 | Port 2 | Port 3 | Port 4 | Upgraded Product | VI |
|---|---|---|---|---|---|---|
| TDU Port Output | 3 ml | 3 ml | 3 ml | 3 ml | | |
| Blend #1 | 2.4 ml | | 2.4 ml | 2 ml | 6.8 ml | 119 |
| Port #2 Product | | 3 ml | | | 3 ml | 117 |
| Total Final Product | | | | | 11.5 ml | |

Use of Multiple Separation Units for Large Scale Separations

In order to achieve commercial scale volumes using liquid thermal separations, a plurality of separation units can be used in tandem to separate a large input flow. For example, an input manifold can be used to distribute a large volume of feedstock to a plurality of separation units that each handle a portion of the flow. After performing a separation, the resulting product outputs can be combined using another manifold structure.

Combination of Liquid Thermal Separation and Hydroprocessing

In some aspects, liquid thermal separation can be used as a complement to various types of hydroprocessing for producing desired products, such as lubricant base oils. Conventional hydroprocessing methods rely on separations based on boiling range for separating products generated during hydroprocessing. Liquid thermal separation allows for separation based on alternative characteristics, such as molecular shape and density. This type of alternative separation can be integrated with various types of hydroprocessing reactions.

In the discussion herein, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts (such as a hydrocracking catalyst and a dewaxing catalyst) may be stacked together in a single catalyst bed, the two catalysts can each be referred to conceptually as separate catalyst beds.

Various types of hydroprocessing can be used in the production of distillate fuels and/or lubricant base oils from a mineral or biocomponent oil feed. Typical processes include hydrocracking processes to provide uplift in the viscosity index (VI) of a feed; dewaxing processes to improve cold flow properties, such as pour point or cloud point; hydrotreatment processes to reduce the amount of sulfur, nitrogen, and other impurities in a feed; and hydrofinishing or aromatic saturation processes for removing aromatics and olefins from a feed.

Hydrotreatment Conditions

Hydrotreatment is typically used to reduce the sulfur, nitrogen, and/or aromatic content of a feed. The catalysts used for hydrotreatment can include conventional hydrotreatment catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydrotreatment catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base oil) boiling range feed in a conventional manner may be used. It is within the scope of the present invention that more than one type of hydroprocessing catalyst can be used in one or multiple reaction vessels.

The at least one Group VIII non-noble metal, in oxide form, can typically be present in an amount ranging from 2 wt % to 30 wt %, preferably from 4 wt % to 15 wt %. The at least one Group VI metal, in oxide form, can typically be present in an amount ranging from 2 wt % to 60 wt %, preferably from 6 wt % to 40 wt % or from 10 wt % to 30 wt %. These weight percents are based on the total weight of the catalyst. Suitable metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to the reactor. The treat gas stream introduced into a reaction stage will preferably contain at least 50 vol. % and more preferably at least 75 vol. % hydrogen.

Hydrogen can be supplied at a rate of from 100 SCF/B (standard cubic feet of hydrogen per barrel of feed) (17.8 $Nm^3/m^3$) to 10000 SCF/B (1781 $Nm^3/m^3$). Preferably, the hydrogen is provided in a range of from 200 SCF/B (34 $Nm^3/m^3$) to 1500 SCF/B (253 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 100 scf/B (17.8 $m^3/m^3$) to 10,000 scf/B (1781 $m^3/m^3$), or 500 (89 $m^3/m^3$) to 10,000 scf/B (1781 $m^3/m^3$).

Hydrocracking Conditions

Hydrocracking of a feed is typically performed when conversion of higher boiling molecules in a feedstock to lower boiling molecules is desired. During such a conversion process, other properties of a feedstock may also be affected, such the viscosity index of a feed. Conversion of the feed can be defined in terms of conversion of molecules that boil above a temperature threshold to molecules below that threshold. The conversion temperature can be any convenient temperature, such as 700° F. (371° C.).

Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Non-limiting examples of metals for hydrocracking catalysts include nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment). It is noted that some conventional hydrotreating catalysts are also suitable for performing hydrocracking under sufficiently severe conditions.

In various embodiments, the conditions selected for hydrocracking for lubricant base oil production can depend on the desired level of conversion, the level of contaminants in the input feed to the hydrocracking stage, and potentially other factors. A hydrocracking process performed under sour conditions, such as conditions where the sulfur content of the input feed to the hydrocracking stage is at least 500 wppm, can be carried out at temperatures of 550° F. (288° C.) to 840° F. (449° C.), hydrogen partial pressures of from 250 psig to 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of 600° F. (343° C.) to 815° F. (435° C.), hydrogen partial pressures of from 500 psig to 3000 psig (3.5 MPag-20.9 MPag), liquid hourly space velocities of from 0.2 $h^{-1}$ to 2 $h^{-1}$ and hydrogen treat gas rates of from 213 $m^3/m^3$ to 1068 $m^3/m^3$ (1200 SCF/B to 6000 SCF/B).

A hydrocracking process performed under non-sour conditions can be performed under conditions similar to those used for a first stage hydrocracking process, or the conditions can be different. Alternatively, a non-sour hydrocracking stage can have less severe conditions than a similar hydrocracking stage operating under sour conditions. Suitable hydrocracking conditions can include temperatures of 550° F. (288° C.) to 840° F. (449° C.), hydrogen partial pressures of from 250 psig to 5000 psig (1.8 MPag to 34.6 MPag), liquid hourly space velocities of from 0.05 $h^{-1}$ to 10 $h^{-1}$, and hydrogen treat gas rates of from 35.6 $m^3/m^3$ to 1781 $m^3/m^3$ (200 SCF/B to 10,000 SCF/B). In other embodiments, the conditions can include temperatures in the range of 600° F. (343° C.) to 815° F. (435° C.), hydrogen partial pressures of from 500 psig to 3000 psig (3.5 MPag-20.9 MPag), liquid hourly space velocities of from 0.2 $h^{-1}$ to 2 $h^{-1}$ and hydrogen treat gas rates of from 213 $m^3/m^3$ to 1068 $m^3/m^3$ (1200 SCF/B to 6000 SCF/B). In some embodiments, multiple hydrocracking stages may be present, with a first hydrocracking stage operating under sour conditions, while a second hydrocracking stage operates under non-sour conditions and/or under conditions where the sulfur level is substantially reduced relative to the first hydrocracking stage. In such embodiments, the temperature in the second stage hydrocracking process can be 40° F. (22° C.) less than the temperature for a hydrocracking process in the first stage, or 80° F. (44° C.) less, or 120° F. (66° C.) less. The pressure for the second stage hydrocracking process can be 100 psig (690 kPa) less than a hydrocracking process in the first stage, or 200 psig (1380 kPa) less, or 300 psig (2070 kPa) less.

In still another embodiment, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

Catalytic Dewaxing Process

In order to enhance diesel production and to improve the quality of lubricant base oils produced from a reaction system, at least a portion of the catalyst in the reaction system can be a dewaxing catalyst. Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of, or be a 10-member ring 1-D molecular sieve. Examples include EU-1, ZSM-35 (or ferrierite), ZSM-11, ZSM-57, NU-87, SAPO-11, ZSM-48, ZSM-23, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from 20:1 to 40:1 can sometimes be referred to as SSZ-32. Other molecular sieves that are isostructural with the above materials include Theta-1, NU-10, EU-13, KZ-1, and NU-23. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

Preferably, the dewaxing catalysts used in processes according to the invention are catalysts with a low ratio of silica to alumina. For example, for ZSM-48, the ratio of silica to alumina in the zeolite can be less than 200:1, or less than 110:1, or less than 100:1, or less than 90:1, or less than 80:1. In various embodiments, the ratio of silica to alumina can be from 30:1 to 200:1, 60:1 to 110:1, or 70:1 to 100:1.

In various embodiments, the catalysts according to the invention further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

Process conditions in a catalytic dewaxing zone in a sour environment can include a temperature of from 200 to 450° C., preferably 270 to 400° C., a hydrogen partial pressure of from 1.8 MPag to 34.6 MPag (250 psig to 5000 psig), preferably 4.8 MPag to 20.8 MPag, a liquid hourly space velocity of from 0.2 $hr^{-1}$ to 10 $hr^{-1}$, preferably 0.5 $hr^{-1}$ to 3.0 $h^{-1}$, and a hydrogen circulation rate of from 35.6 $m^3/m^3$ (200 SCF/B) to 1781 $m^3/m^3$ (10,000 scf/B), preferably 178 $m^3/m^3$ (1000 SCF/B) to 890.6 $m^3/m^3$ (5000 SCF/B). In still other embodiments, the conditions can include temperatures in the range of 600° F. (343° C.) to 815° F. (435° C.), hydrogen partial pressures of from 500 psig to 3000 psig (3.5 MPag-20.9 MPag), and hydrogen treat gas rates of from 213 $m^3/m^3$ to 1068 $m^3/m^3$ (1200 SCF/B to 6000 SCF/B). These latter conditions may be suitable, for example, if the dewaxing stage is operating under sour conditions.

Additionally or alternately, the conditions for dewaxing can be selected based on the conditions for a preceeding reaction in the stage, such as hydrocracking conditions hydrotreating conditions. Such conditions can be further modified using a quench between previous catalyst bed(s) and the bed for the dewaxing catalyst. Instead of operating the dewaxing process at a temperature corresponding to the exit temperature of the prior catalyst bed, a quench can be used to reduce the temperature for the hydrocarbon stream at the beginning of the dewaxing catalyst bed. One option can be to use a quench to have a temperature at the beginning of the dewaxing catalyst bed that is the same as the inlet temperature of the prior catalyst bed. Another option can be to use a quench to have a temperature at the beginning of the dewaxing catalyst bed that is at least 10° F. (6° C.) lower than the prior catalyst bed, or at least 20° F. (11° C.) lower, or at least 30° F. (16° C.) lower, or at least 40° F. (21° C.) lower.

As still another option, the dewaxing catalyst in the final reaction stage can be mixed with another type of catalyst, such as hydrocracking catalyst, in at least one bed in a reactor. As yet another option, a hydrocracking catalyst and a dewaxing catalyst can be co-extruded with a single binder to form a mixed functionality catalyst.

Hydrofinishing and/or Aromatic Saturation Process

In some aspects, a hydrofinishing and/or aromatic saturation stage can also be provided. Typically, a hydrofinishing and/or aromatic saturation can occur after the last hydrocracking or dewaxing stage, but other locations for a hydrofinishing stage in a reaction system may also be suitable. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on the bottoms from the reaction stage (i.e., the hydrocracker bottoms). Alternatively, the entire effluent from the last hydrocracking or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from 125° C. to 425° C., preferably 180° C. to 280° C., a hydrogen partial pressure from 500 psig (3.4 MPa) to 3000 psig (20.7 MPa), preferably 1500 psig (10.3 MPa) to 2500 psig (17.2 MPa), and liquid hourly space velocity from 0.1 $hr^{-1}$ to 5 $hr^{-1}$ LHSV, preferably 0.5 $hr^{-1}$ to 1.5 $hr^{-1}$. Additionally, a hydrogen treat gas rate of from 35.6 $m^3/m^3$ to 1781 $m^3/m^3$ (200 SCF/B to 10,000 SCF/B) can be used.

Configuration Example 4

Efficient Product Separation Using Liquid Thermal Diffusion

FIGS. 10-14 schematically show various process configurations suitable for combining hydroprocessing of a feedstock with liquid thermal diffusion. Of course, the configurations shown in FIGS. 10-14 are exemplary, and use of liquid thermal diffusion with hydroprocessing is not limited to only the configurations shown in FIGS. 10-14.

Figure 10:
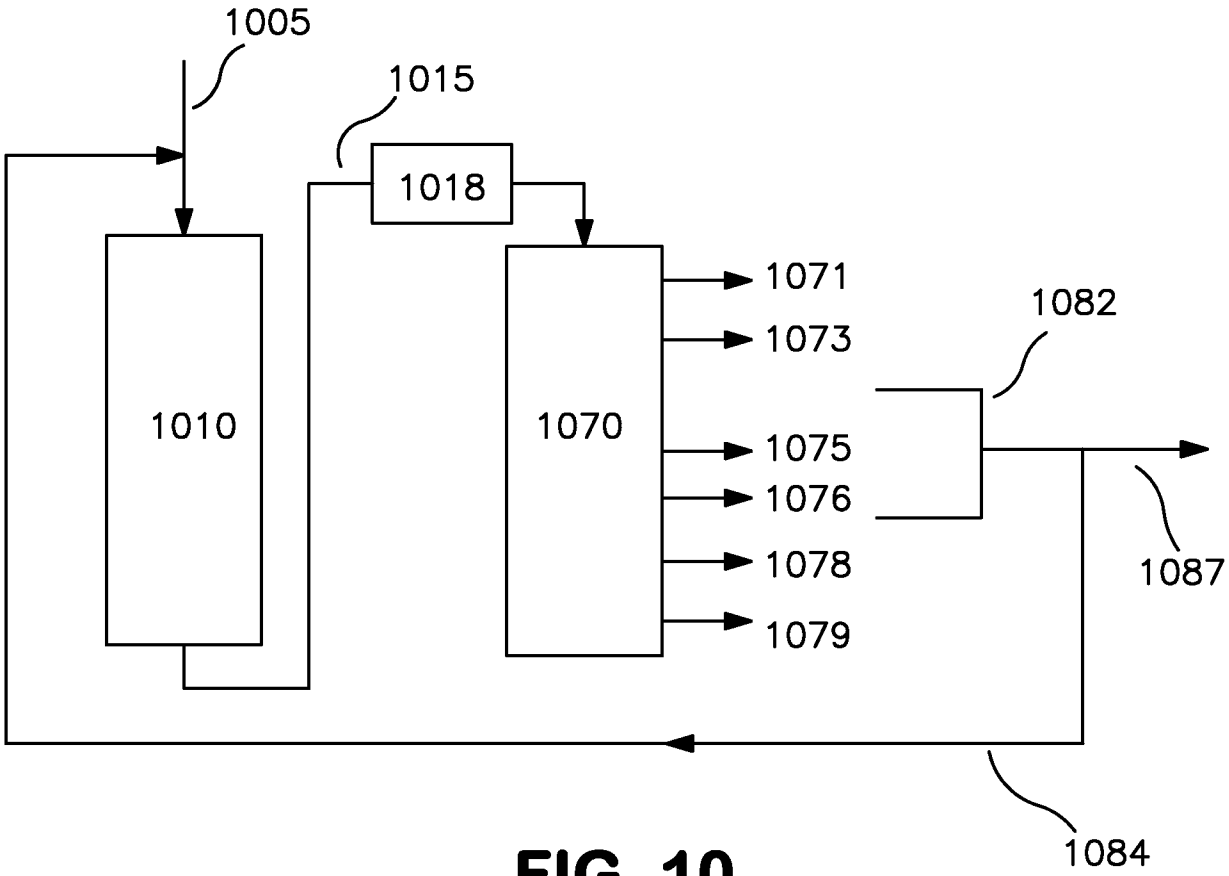
FIGS. 10 to 14 show various configurations for performing a field enhanced separation as part of processing of a feedstock.

FIG. 10 provides a basic configuration for performing hydroprocessing in conjunction with use of a liquid thermal diffusion separator. In FIG. 10, a hydroprocessing reactor 1010 is used to hydroprocess a feedstock 1005. An example of a suitable feedstock is a vacuum gas oil, a vacuum bottoms and/or asphalt feed, a light neutral distillate, a light cycle oil, a slack wax and/or Fischer-Tropsch wax stream, a biologically-derived oil and/or wax, or a combination thereof. Additionally or alternately, the feedstock can be defined based on a boiling range, as previously described.

The effluent 1015 from hydroprocessing reactor 1010 is then passed into one or more liquid thermal diffusion separators 1070. Optionally, the effluent 1015 can be separated 1018 prior to entering liquid thermal diffusion separator 1070 to remove lower boiling components, such as light ends and/or naphtha boiling range components. A gas-liquid separator, a flash separator, a high pressure separator, or other types of separation devices may be suitable for performing the separation. The liquid thermal diffusion separator 1070 generates a plurality of output streams or products. In the example shown in FIG. 10, 6 output streams are shown. These products correspond to a wax output 1071, an output 1073 with properties suitable for use as a feed for making Group II/Group III lubricant base oils, an alkylnaphthalene output 1075, a diesel or distillate fuel output 1076, an extender oil product 1078, and an output 1079 containing the lowest viscosity index (VI) portions of the effluent 1015. This low VI output 1079 may sometimes be referred to as an "extract" output. In various other aspects, different numbers and/or types of outputs can be generated as desired. Thus, the 6 output streams 1071, 1073, 1075, 1076, 1078, and 1079 are representative of the variety of potential output streams that can be produced.

The output streams from liquid thermal diffusion separator(s) 1070 can be used for a variety of purposes. Wax stream 1071 and lubricant base oil stream 1073 represent high viscosity index streams that are separated out using liquid thermal diffusion separator 1070. Alkylnaphthalenes 1075 may be useful for blending either with a lubricant base oil product or with a diesel product. Distillate fuel product 1076 can include both diesel and kerosene fractions, depending on the input feed provided to the separation. Extender oil 1078 and extract 1079 can be used as fuel oils or for other lower value purposes.

In one aspect, hydroprocessing can be used in combination with liquid thermal diffusion based on a single pass of a feedstock 1005 through the hydroprocessing reaction 1010 and the liquid thermal diffusion separator(s) 1070. For example, a vacuum gas oil feed, optionally blended with other distillate boiling range components, can be used as the feed 1005. The hydroprocessing reactor 1010 can be used to hydrotreat the feed under effective hydrotreating conditions. This results in a modest amount of conversion of the feed relative to a 700° F. (371° C.) boiling point, as well as removal of contaminants such as sulfur and nitrogen. Some aromatic saturation may also occur. In this aspect, effluent 1015 corresponds to a hydrotreated effluent. The liquid thermal diffusion separator(s) 1070 can then separate the hydrotreated effluent 1015, after optional separation 1018 to remove low boiling components. The liquid thermal diffusion separation results in a plurality of products or outputs, such as the outputs 1071, 1073, 1075, 1076, 1078, and 1079 shown in FIG. 10.

In some optional aspects, a portion of the output from the liquid thermal separator 1070 can be recycled for combination with feed 1005. In these types of optional aspects, higher VI components would not be recycled, as these are high value products. Thus, components with a VI of at least 80, preferably at least 90, such as at least 100, are not recycled. Additionally, components with a low VI, such as components with a VI of 40 or less, such as 30 or less, are also not recycled. The remaining intermediate VI products can be recycled for further hydroprocessing, in order to upgrade the intermediate VI products to products with higher viscosity index. In FIG. 10, portions of the outputs from liquid thermal diffusion separator 1070 are shown as potential candidates for recycle. In the example shown in FIG. 10, output portion 1082 corresponds to a portion of the alkylnaphthalene output 1075 and diesel output 1076, although a portion of lubricant base oil output 1073 may also be included. When recycle is desired, a recycle stream 1084 is formed from output portion 1082 and combined with feedstock 1005 into hydroprocessing reaction 1010. One way of determining if recycle is desired is to perform recycle so long as the recycle increases the amount of high VI product in the output of the liquid thermal separator 1070. When addition of recycle stream 1084 to feedstock 1005 does not result in an increase in high VI product, the output portion 1082 can instead by used as an output or product stream 1087.

In aspects where an output portion 1082 is recycled, hydroprocessing reactor 1010 can correspond to a variety of types of hydroprocessing, such as hydroconversion (either hydrotreatment or hydrocracking) or catalytic dewaxing (or other types of hydroisomerization). In an alternative embodiment, the configuration in FIG. 10 can also be used with an asphalt feedstock, with reactor 1010 corresponding to an air blower rather than a hydroprocessing unit.

Configuration Example 5

Enriching Feedstock with Desired Components for Hydroprocessing

Figure 11:
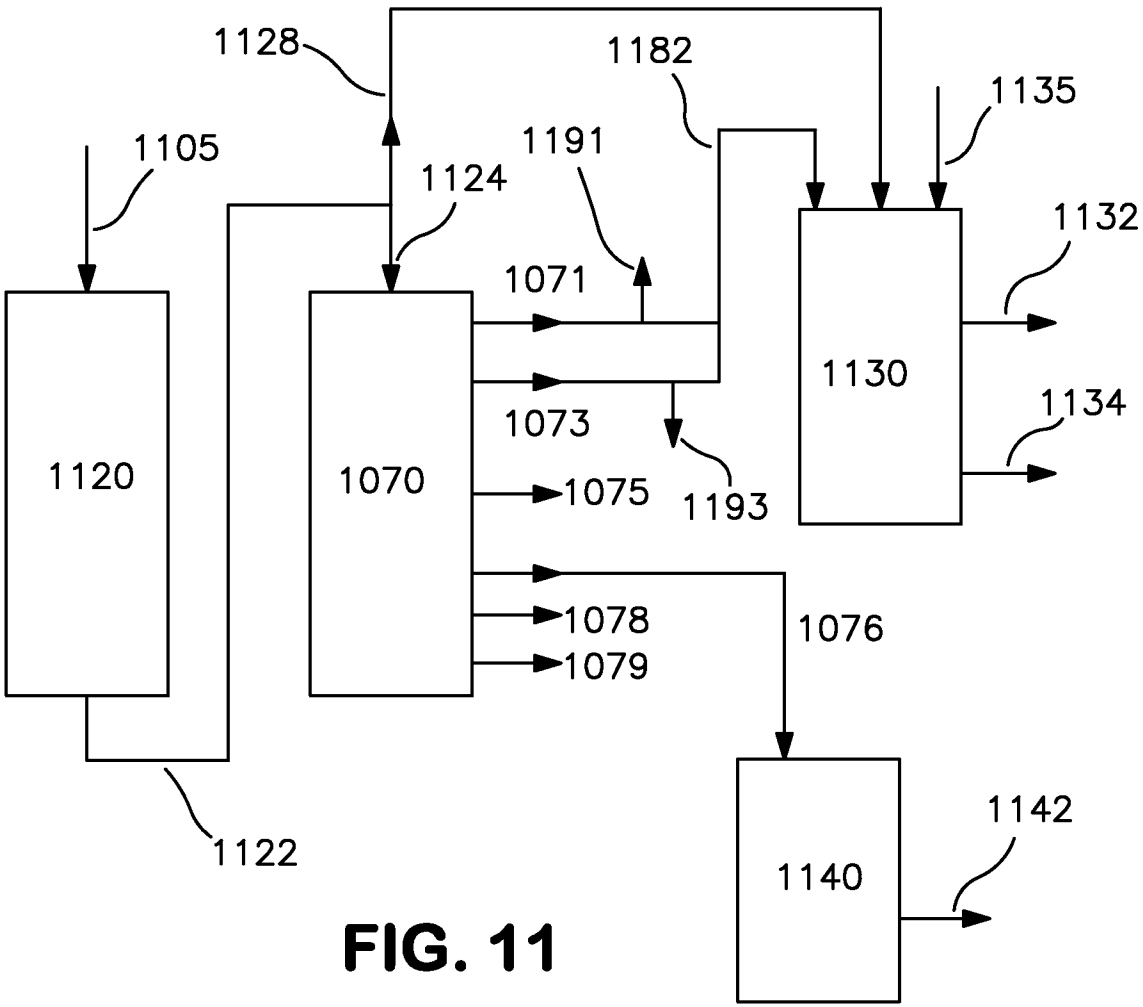

FIG. 11 schematically shows another configuration for using hydroprocessing in conjunction with separation by liquid thermal diffusion. In the types of configurations represented by FIG. 11, a feedstock is separated using liquid thermal diffusion so that hydroprocessing is performed on only a portion of the feedstock. In some aspects, a feedstock can be split into two portions for processing. A first portion can be separated using liquid thermal diffusion while a second portion is directly passed into one or more hydroprocessing stages. After separation, one or more outputs from the liquid thermal diffusion separator can be used to enhance the content of certain types of molecules in the second portion. For example, a liquid thermal diffusion separation can be used on a portion of a feedstock to isolate high viscosity index components, such as waxy components or lubricant base oil components. These isolated high VI components can then be added to a remaining portion of the feedstock to provide a feedstock for hydroprocessing that is enriched in components suitable for making lubricant base oils.

In FIG. 11, a feedstock 1105 can initially undergo an optional hydrotreatment 1120. The feedstock 1105 can be a vacuum gas oil or another type of distillate and/or gas oil boiling range feedstock. Optionally, the feedstock 1105 can also include some molecules that would correspond to vacuum bottoms boiling range material. In aspects where hydrotreatment 1120 is not used, feedstock 1105 can be passed directly into liquid thermal diffusion separator 1070. As shown in FIG. 11, feedstock 1105 is initially hydrotreated 1120, and the hydrotreated effluent is passed into liquid thermal diffusion separator 1070. Optionally, the hydrotreated effluent can undergo a flash or gas-liquid separation to remove lower boiling components before being passed into liquid thermal diffusion separator 1070. The liquid thermal diffusion separator 1070 generates a plurality of output streams, such as outputs 1071, 1073, 1075, 1076, 1078, and 1079.

Portions of the one or more of the products from liquid thermal diffusion separator 1070 can then undergo further hydroprocessing. One option is to perform additional hydrotreatment 1140 on a diesel or distillate fuel product 1076. This results in a hydrotreated diesel or distillate fuel product 1142. Another option is to perform additional hydroprocessing on at least a portion of wax output 1071 and/or lubricant base oil output 1073. If only a portion of wax output 1071 is exposed to further hydroprocessing, the remaining portion 1191 may be used directly as a product or as an input for other processes. Similarly, if only a portion of lubricant base oil output 1073 is exposed to further hydroprocessing, the remaining portion 1193 may be used directly as a product or as an input for other processes.

The portions of outputs 1071 and 1073 that are exposed to further hydroprocessing correspond to stream 1182, which is then hydroprocessed in reactor or reaction stages 1130. Typically, stream 1182 will represent less than half by weight of the input flow to hydroprocessing reactor 1130. For example, if feedstock 1105 is hydrotreated 1120, then portion 1124 that is passed into liquid thermal separator 1070 will typically represent less than half of the weight of hydrotreated effluent 1122. The remaining portion of effluent 1122 forms an input stream 1128 for hydroprocessing 1130. Additionally or alternately, additional feedstock 1135 can be introduced into hydroprocessing reactor 1130. If feedstock 1105 is not hydrotreated prior to entering separator 1070, then the weight of feedstock 1105 will typically be less than the weight of feedstock 1135. In some aspects, feedstock 1105 and feedstock 1135 can be derived from a common source of feedstock, such as corresponding to the same vacuum gas oil or other distillate/gas oil boiling range feed.

Input stream 1182, along with at least one of hydrotreated effluent portion 1128 or feedstock 1135, are then hydroprocessed 1130. A variety of types of hydroprocessing may be performed in the reaction stages corresponding to hydroprocessing reactor 1130. Suitable types of hydroprocessing include hydrotreatment to reduce contaminant levels, hydrocracking for VI uplift, and dewaxing to improve cold flow properties. For example, in some aspects an initial hydrotreatment 1120 may not be performed, so that the inputs to hydroprocessing 1130 are stream 1182 and feedstock 1135. In such aspects, hydroprocessing reactor 1130 can include one or more initial stages for hydrotreatment followed by one or more stages of hydrocracking and/or catalytic dewaxing. If an initial hydrotreatment 1120 is performed (or if feedstocks 1105 and 1135 have sufficiently low contents of contaminant species), additional hydrotreatment in hydroprocessing reaction stages 1130 may not be necessary, so that hydroprocessing 1130 corresponds to one or more stages of hydrocracking, one or more stages of catalytic dewaxing, or a combination thereof. The outputs from hydroprocessing 1130 can correspond to diesel or distillate fuel output 1132 and lubricant base oil output 1134. In many aspects, diesel output 1132 may correspond to a diesel with improved pour point or other low temperature properties, due to at least one catalytic dewaxing stage being present in hydroprocessing reaction stages 1130. Similarly, lubricant base oil output 1134 may be suitable for use as a Group II+ or Group III base oil. In various aspects, one or more hydrofinishing stages may also be included as part of hydroprocessing 1130. Alternatively, hydrofinishing may be performed on one of the output streams from hydroprocessing 1130, such as lubricant base oil output 134.

Configuration Example 6

Process Stage Bypass Configurations

Figure 12:
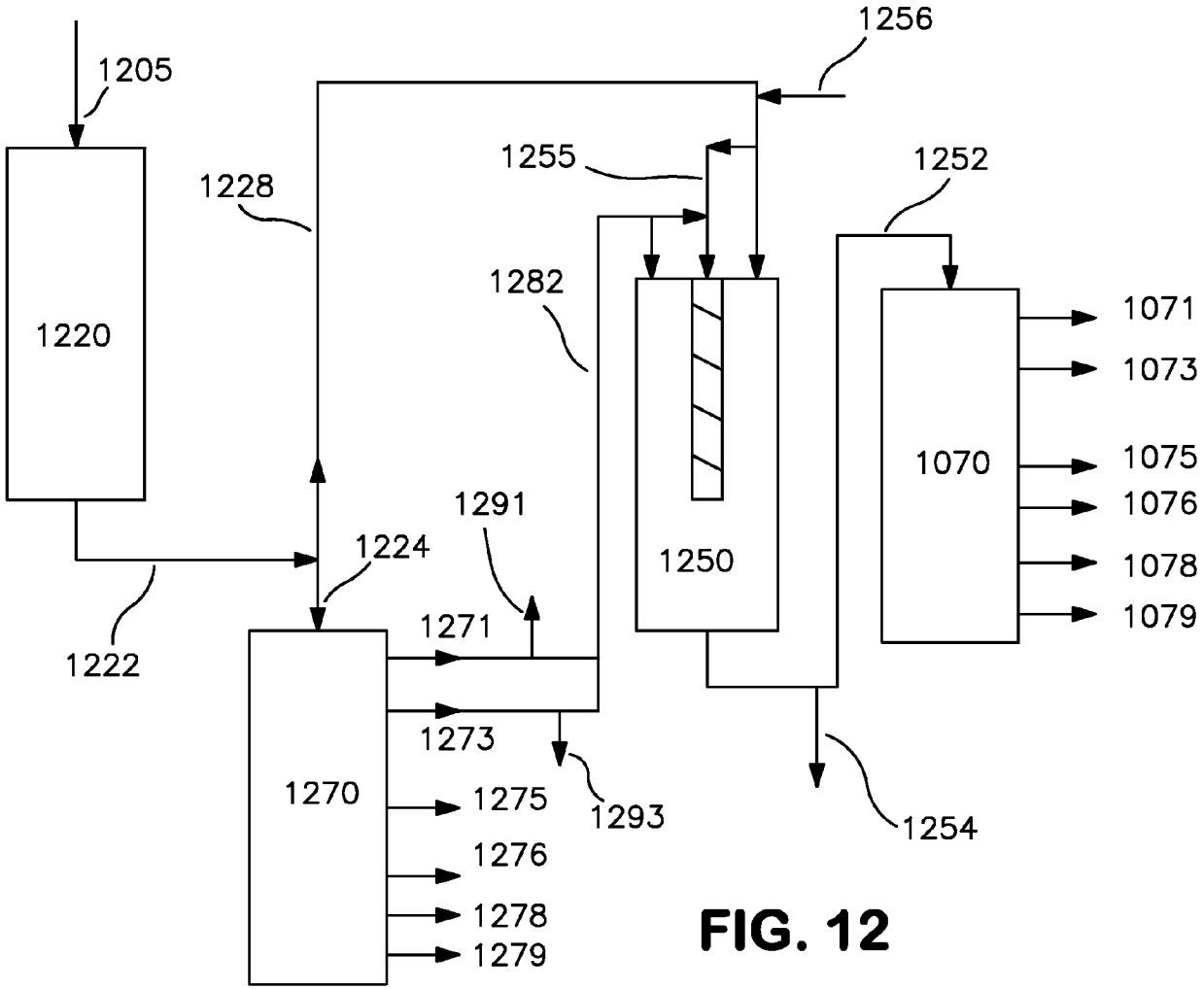

FIG. 12 shows an example of a configuration where portions of a feed are allowed to bypass one or more hydroprocessing stages. Bypass of processing stages can be used to allow for processing of two different types of feedstocks, with one feedstock being passed into a reaction system at a downstream stage of hydroprocessing. One way of generating two different types of feedstocks is to start with a single feedstock and perform a liquid thermal diffusion separation on a portion of the feed. This can allow for separation out or selection of desired portions of the feed, such as a portion suitable for forming lubricant base oils. This selected portion of the feed can then be treated using additional hydroprocessing stages, while the main portion of the feedstock is exposed to a more limited form of hydroprocessing. These types of configurations can allow hydroprocessing reactions to be targeted to higher value portions of a feedstock, thus reducing or avoiding excess processing of lower value portions of a feed.

In FIG. 12, an initial hydrotreatment can be performed 1220 on a feedstock 1205. The feedstock 1205 can be any suitable feedstock, such as a vacuum gas oil feed or a vacuum gas oil feed blended with one or more other feeds. At least a portion of the resulting hydrotreated effluent 1222 can then be used as an input stream 1228 for further hydroprocessing. Depending on the aspect, all of input stream 1228 can be exposed to all of the beds in hydroprocessing reaction stages 1250. Alternatively, a portion of input stream 1228 can be diverted to form a bypass stream 1255 that bypasses one or more catalyst beds or reaction stages. Optionally, an additional feedstock stream 1256 can also be introduced into reaction stages 1250, either for exposure to all reaction stages or as a bypass stream.

The effluent from reaction stages 1250 can be handled in various ways. As shown in FIG. 12, a portion of the effluent from reaction stages 1250 can be used as an input stream 1254 for a conventional fractionator, in order to form distillate fuel and/or lubricant base oil fractions. The remaining portion of the effluent from reaction stages 1250 can be used as an input stream 1252 for a liquid thermal diffusion separator 1070.

The hydroprocessing in hydroprocessing stages 1250 can be of any convenient type. Suitable reaction stages include hydrotreatment, hydrocracking, and catalytic dewaxing stages. For example, the hydroprocessing stages 1250 can correspond to one or more first catalytic dewaxing stages, one or more hydrocracking stages, and one or more second catalytic dewaxing stages. The bypass stream 1255 can bypass at least a portion of the first catalytic dewaxing stages, or the bypass stream 1255 can bypass both the first catalytic dewaxing stages and at least a portion of the hydrocracking stages. Alternatively, reaction stages 1250 can correspond to one or more hydrocracking stages or a combination of hydrotreating and hydrocracking stages. Still another option is to use any desired combination of hydrotreating, hydrocracking, and catalytic dewaxing stages.

In some aspects, a portion of hydrotreated effluent 1222 can be used to form a side stream 1224. The side stream 1224 can be passed into another liquid thermal diffusion separator 1270 in order to form a stream 1282 that can increase the quantity of a desired component in stream 1228, stream 1255, or another input stream to reaction stages 1250. As shown in FIG. 12, stream corresponds to a wax stream while stream 1273 corresponds to a stream suitable for forming lubricant base oils. Portions of these streams can be used as output or product streams 1291 and 1293. The remainder of these streams can be used to form stream 1282 for enriching the input to hydroprocessing stages 1250. Other possible representative outputs from separation 1270 of the side stream 1224 are alkylnaphthalenes 1275, distillate fuels 1276, extender oil 1278, and extract 1279.

Configuration Example 7

Figure 13:
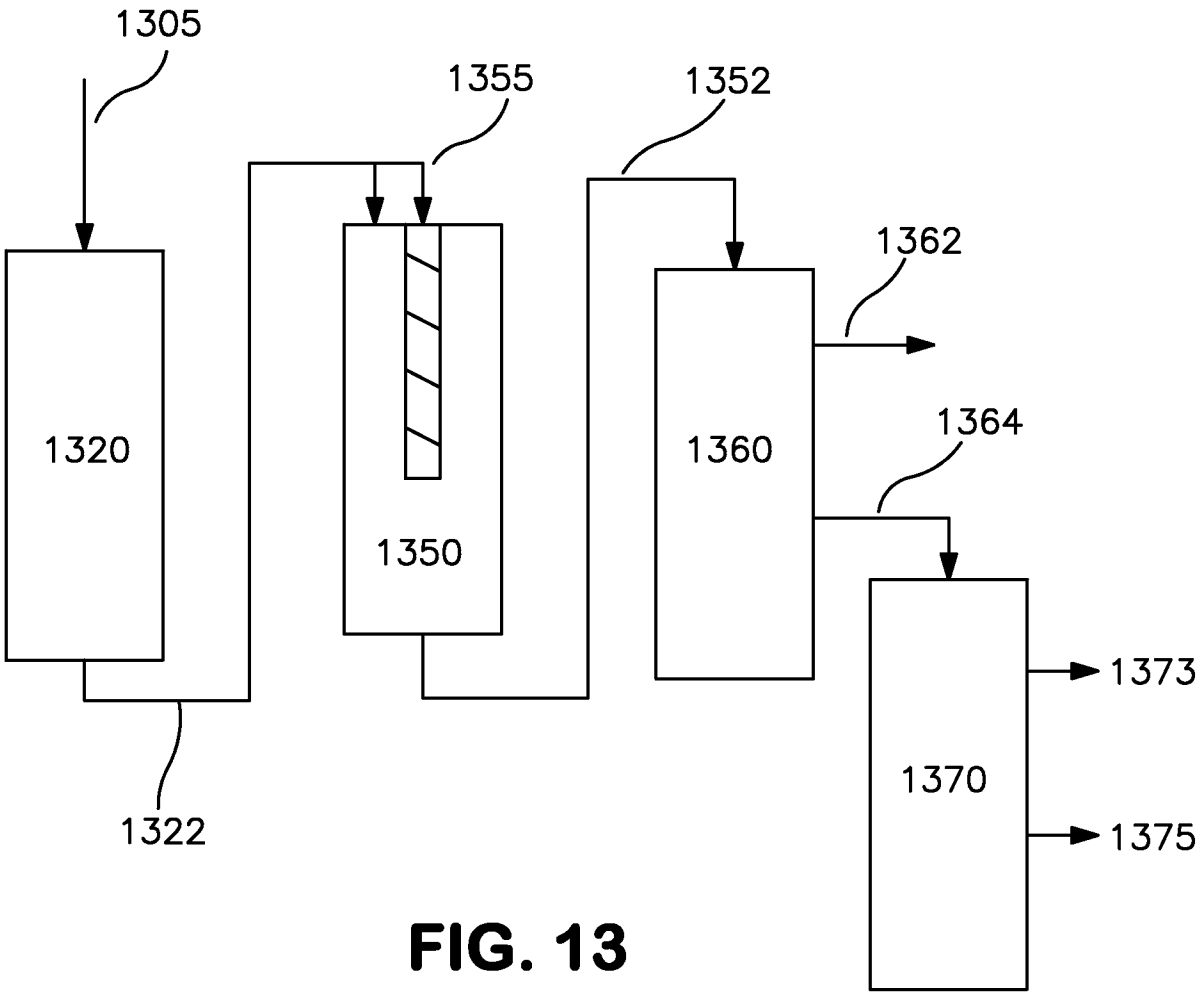
Figure 14:
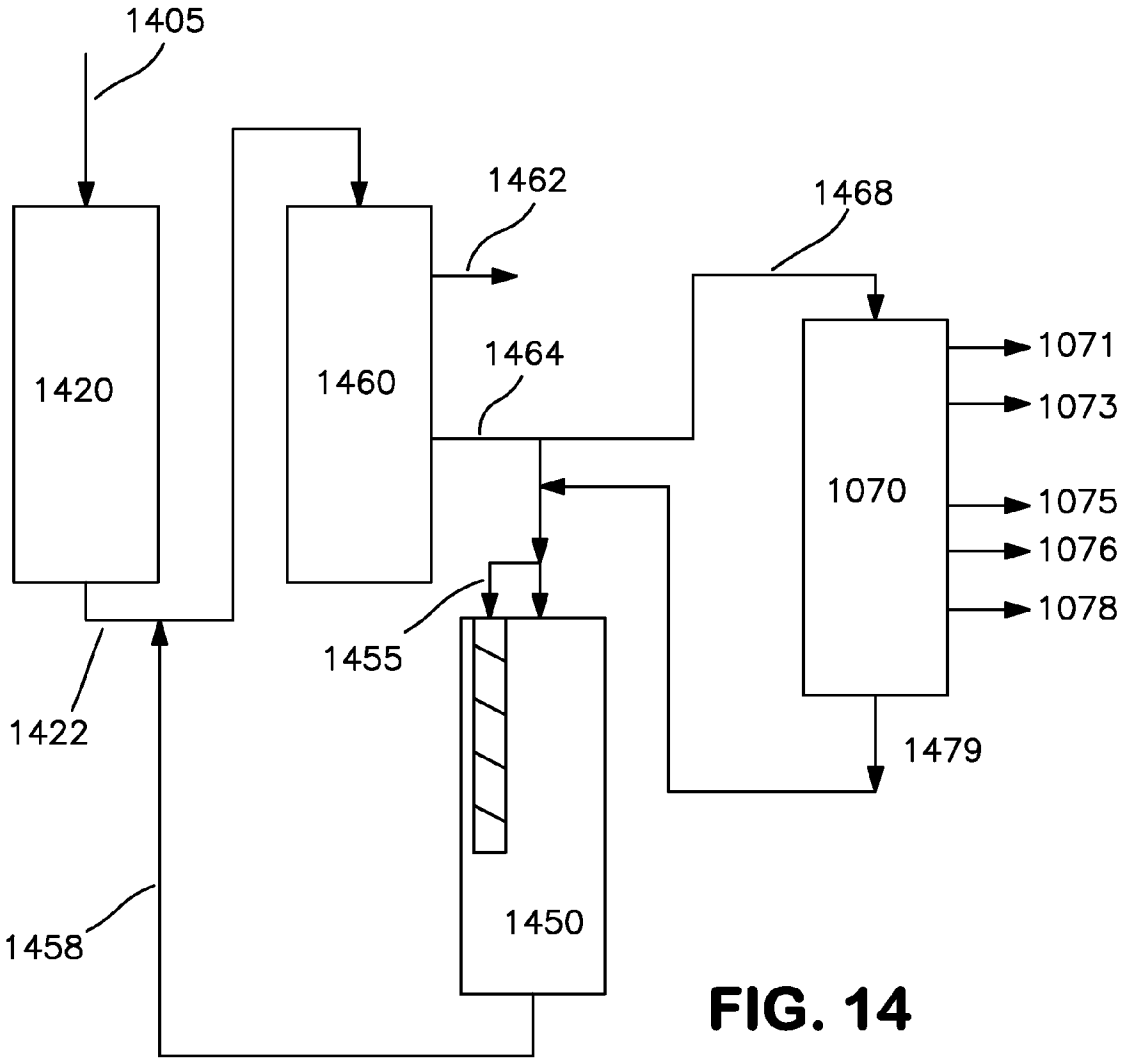

Combination of Temperature Fractionation and Liquid Thermal Diffusion Separation Still another option is to use both separations based on boiling range and separations based on liquid thermal diffusion to achieve a desired product slate. FIGS. 13 and 14 show examples of configurations where an atmospheric distillation unit is used in combination with a liquid thermal diffusion separator to generate various outputs. These types of aspects reduce the total volume of the outputs that are processed using liquid thermal diffusion while still allowing for production of outputs not conventionally available using only a temperature based fractionation.

In FIG. 13, a feedstock 1305 is hydrotreated 1320 to remove contaminants. Optionally, a portion of hydrotreatment stage 1320 can also include another type of hydroprocessing catalyst, such as hydrocracking catalyst. The hydrotreated effluent 1322 can then be hydroprocessed 1350, such as by catalytic dewaxing, hydrocracking, and/or hydrofinishing. For example, the hydrotreated effluent can be catalytically dewaxed in a first stage, hydrocracked in a second stage, and catalytically dewaxed in a third stage. Optionally, a portion of hydrotreated effluent 1322 can be used to form a bypass input 1355 that bypasses one or more stages of hydroprocessing stages 1350.

The effluent 1352 from hydroprocessing stages 1350 can then be fractionated 1360, such as by using an atmospheric distillation unit. An initial gas-liquid separator can optionally be used to remove light ends and/or naphtha boiling range molecules before effluent 1352 enters fractionator 1360. The fractionator 1360 can separate the effluent 1352 into one or more fuels output streams 1352, such as one or more kerosene outputs and one or more diesel outputs. A bottoms portion 1364 from fractionator 1360 can then be used as the input for a liquid thermal diffusion separator 1370. The bottoms portion can correspond, for example, to a 700° F.+ (371° C.+) portion of the effluent 1352. The liquid thermal diffusion separator 1370 can separate the bottoms portion 1364 into any convenient number of output streams. For example, FIG. 13 shows formation of a lubricant base oil output 1373 and an alkylnaphthalene output 1375. The liquid thermal diffusion separator 1370 may also produce one or more additional outputs corresponding to lower value molecules in the bottoms portion 1364. It is noted that the diesel portion of the hydroprocessing effluent 1352 was already removed by fractionator 1360.

FIG. 14 shows an alternative configuration where similar processing stages are used, but the stages are organized differently. In FIG. 14, a feedstock 1405 is hydrotreated 1420. The hydrotreated effluent 1422 is combined with a hydroprocessed output 1458. The combined stream, after optional separation to remove low boiling molecules, is passed into a fractionator 1460, such as an atmospheric distillation unit.

This results in one or more output streams, such as a distillate fuel output 1462. The bottoms portion 1464 is then split to form an input stream for hydroprocessing unit 1450 and a stream 1468 for separation in a liquid thermal diffusion separator 1070. The extract portion 1479 from separator 1070 is recycled and added to the input stream to hydroprocessing stages 1450. Optionally, a portion of the input stream to hydroprocessing stages 1450 can be used to form a bypass stream 1455 that bypasses one or more of the hydroprocessing stages. By using the extract 1479 from separator 1070 as a recycle feed, the configuration in FIG. 14 allows for an increase in the amount of fuels and lubricant base oil products formed from a feedstock 1405.

Additional Embodiments

Embodiment 1. A method for processing a feedstock, comprising: treating a feedstock with a T5 boiling point of at least 350° C., the feedstock comprising a recycled portion, in one or more hydroprocessing stages under effective hydroprocessing conditions to form a hydroprocessed effluent; passing at least a portion of the hydroprocessed effluent into a gap between a first surface and a second surface in a thermal diffusion separator; performing thermal diffusion separation by maintaining the at least a portion of the hydroprocessed effluent in the gap with a temperature differential between the first surface and the second surface of at least 5° C., such as at least 50° C., for a residence time; withdrawing a plurality of fractions from the thermal diffusion separator including a first fraction having a viscosity index of at least 80, a second fraction having a viscosity index less than the first fraction and less than 90, and a third fraction having a viscosity index less than the second fraction; and recycling at least a portion of the second fraction to form the recycled portion.

Embodiment 2. A method for processing a feedstock, comprising: treating a feedstock with a T5 boiling point of at least 350° C. in one or more first hydroprocessing stages under effective hydroprocessing conditions to form a first hydroprocessed effluent; passing a first portion of the first hydroprocessed effluent into a gap between a first surface and a second surface in a thermal diffusion separator, performing thermal diffusion separation by maintaining the first portion of the first hydroprocessed effluent portion in the gap with a temperature differential between the first surface and the second surface of at least 5° C., such as at least 50° C., for a residence time; withdrawing a plurality of fractions from the thermal diffusion separator including a first separated fraction and a second separated fraction, the second separated fraction having a viscosity index of at least 80; and treating a second portion of the first hydroprocessed effluent and the second separated fraction in one or more second hydroprocessing stages under second effective hydroprocessing conditions to form a second hydroprocessed effluent.

Embodiment 3. The method of Embodiment 2, wherein withdrawing a plurality of fractions further comprises withdrawing a third separated fraction.

Embodiment 4. The method of Embodiments 1 or 3, wherein the third separated fraction is treated in one or more third hydroprocessing stages under third effective hydroprocessing conditions to form a distillate fuel product.

Embodiment 5. The method of any of Embodiments 1, 3, or 4, wherein withdrawing a plurality of fractions from the thermal diffusion separator further comprises withdrawing a fourth fraction having a viscosity index less than the first fraction and greater than the third fraction.

Embodiment 6. The method of Embodiment 5, wherein the recycled portion comprises at least a portion of the fourth fraction.

Embodiment 7. The method of any of the above embodiments, further comprising separating the hydroprocessed effluent to form at least a liquid effluent, wherein at least a portion of the liquid effluent is passed into the gap between the first surface and the second surface.

Embodiment 8. The method of any of the above embodiments, wherein the first effective hydroprocessing conditions comprise at least one of hydrotreating conditions and hydrocracking conditions.

Embodiment 9. The method of any of the above embodiments, wherein the one or more hydroprocessing stages comprise at least one hydrotreating stage and at least one catalytic dewaxing stage.

Embodiment 10. The method of any of the above embodiments, wherein the second separated fraction has a first value for a first property and a second value for a second property, the method further comprising: blending at least a portion of the first separated fraction and at least a portion of the third separated fraction to form a blended fraction, the blended fraction having a third value for the first property that differs from the first value by 2.5% or less and a fourth value for the second property that differs from the second value by at least 5.0%.

Embodiment 11. The method of any of the above embodiments, wherein withdrawing a plurality of fractions from the thermal diffusion separator includes withdrawing the first separated fraction, a third separated fraction, and a fourth separated fraction, the first separated fraction having a first value for a first property and a second value for a second property, the method further comprising: blending at least a portion of the third separated fraction and at least a portion of the fourth separated fraction to form a blended fraction, the blended fraction having a third value for the first property that differs from the first value by 2.5% or less and a fourth value for the second property that differs from the second value by at least 5.0%.

Embodiment 12. The method of Embodiment 11, wherein the fourth separated fraction has a viscosity index that is greater than the first separated fraction.

Embodiment 13. The method of any of the above embodiments, wherein the third separated fraction being treated in one or more third hydroprocessing stages under third effective hydroprocessing conditions, such as hydrotreating conditions, to form a distillate fuel product.

Embodiment 14. The method of any of the above embodiments, wherein the second effective hydroprocessing conditions comprise hydrotreating conditions, hydrocracking conditions, or catalytic dewaxing conditions, such as wherein the one or more second hydroprocessing stages comprise at least one hydrotreating stage followed by at least one hydrocracking stage, or wherein the one or more second hydroprocessing stages comprise at least one hydrotreating stage followed by at least one catalytic dewaxing stage, or wherein the one or more second hydroprocessing stages comprise at least one hydrocracking stage followed, at least one catalytic dewaxing stage, or a combination thereof.

Embodiment 15. The method of any of the above embodiments, further comprising: passing at least a portion of the second hydroprocessed effluent into a second gap in a second thermal diffusion separator; and withdrawing a plurality of fractions from the second thermal diffusion separator.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for processing a feedstock, comprising:

treating a feedstock with a T5 boiling point of at least 350° C. in one or more first hydroprocessing stages under effective hydroprocessing conditions to form a first hydroprocessed effluent;

passing a first portion of the first hydroprocessed effluent into a gap between a first surface and a second surface in a thermal diffusion separator;

performing thermal diffusion separation by maintaining the first portion of the first hydroprocessed effluent portion in the gap with a temperature differential between the first surface and the second surface of at least 5° C. for a residence time;

withdrawing a plurality of fractions from the thermal diffusion separator including a first separated fraction and a second separated fraction, the second separated fraction having a viscosity index of at least 80; and treating a second portion of the first hydroprocessed effluent and the second separated fraction in one or more second hydroprocessing stages under second effective hydroprocessing conditions to form a second hydroprocessed effluent.

2. The method of claim 1, wherein withdrawing a plurality of fractions further comprises withdrawing a third separated fraction, the third separated fraction being treated in one or more third hydroprocessing stages under third effective hydroprocessing conditions to form a distillate fuel product.

3. The method of claim 2, wherein the third effective hydroprocessing conditions comprise hydrotreating conditions.

4. The method of claim 1, wherein the second effective hydroprocessing conditions comprise hydrotreating conditions, hydrocracking conditions, or catalytic dewaxing conditions.

5. The method of claim 4, wherein the one or more second hydroprocessing stages comprise at least one hydrotreating stage followed by at least one hydrocracking stage.

6. The method of claim 4, wherein the one or more second hydroprocessing stages comprise at least one hydrotreating stage followed by at least one catalytic dewaxing stage.

7. The method of claim 4, wherein the one or more second hydroprocessing stages comprise at least one hydrocracking stage, at least one catalytic dewaxing stage, or a combination thereof.

8. The method of claim 1, wherein treating a second portion of the first hydroprocessed effluent and the second separated fraction in one or more second hydroprocessing stages comprises bypassing at least one of the one or more second hydroprocessing stages with at least a portion of the second separated fraction, at least a portion of the second portion of the first hydroprocessed effluent, or a combination thereof.

9. The method of claim 1, further comprising:

passing at least a portion of the second hydroprocessed effluent into a second gap in a second thermal diffusion separator; and withdrawing a plurality of fractions from the second thermal diffusion separator.

10. The method of claim 1, wherein withdrawing a plurality of fractions from the thermal diffusion separator includes withdrawing the first separated fraction, the second separated fraction, and a third separated fraction, the first separated fraction having a first value for a first property and a second value for a second property, the method further comprising:

blending at least a portion of the second separated fraction and at least a portion of the third separated fraction to form a blended fraction, the blended fraction having a third value for the first property that differs from the first value by 2.5% or less and a fourth value for the second property that differs from the second value by at least 5.0%.

11. The method of claim 1, wherein withdrawing a plurality of fractions from the thermal diffusion separator includes withdrawing the first separated fraction, a third separated fraction, and a fourth separated fraction, the first separated fraction having a first value for a first property and a second value for a second property, the method further comprising:

blending at least a portion of the third separated fraction and at least a portion of the fourth separated fraction to form a blended fraction, the blended fraction having a third value for the first property that differs from the first value by 2.5% or less and a fourth value for the second property that differs from the second value by at least 5.0%.

* * * * *